US011975249B2

(12) United States Patent
Taylor et al.

(10) Patent No.: US 11,975,249 B2
(45) **Date of Patent: *May 7, 2024**

(54) IRON-TYPE GOLF CLUB HEAD

(71) Applicant: Taylor Made Golf Company, Inc, Carlsbad, CA (US)

(72) Inventors: Scott Taylor, Bonita, CA (US); Adam Warren, Escondido, CA (US); Jason Issertell, Carlsbad, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 144 days.

This patent is subject to a terminal disclaimer.

(21) Appl. No.: 17/717,903

(22) Filed: Apr. 11, 2022

(65) Prior Publication Data

US 2022/0314082 A1 Oct. 6, 2022

Related U.S. Application Data

(63) Continuation of application No. 16/673,701, filed on Nov. 4, 2019, now Pat. No. 11,338,183, which is a (Continued)

(51) Int. Cl.
*A63B 53/04* (2015.01)
*A63B 53/02* (2015.01)
(Continued)

(52) U.S. Cl.
CPC ..... *A63B 53/047* (2013.01); *A63B 53/02* (2013.01); *A63B 53/0475* (2013.01);
(Continued)

(58) Field of Classification Search
CPC ..... A63B 53/047; A63B 53/02; A63B 60/52; A63B 53/0475; A63B 53/023;
(Continued)

(56) References Cited

U.S. PATENT DOCUMENTS 4,630,825 A 12/1986 Schmidt et al.
4,824,110 A 4/1989 Kobayashi
(Continued)

OTHER PUBLICATIONS

Callaway Big Birtha OS Irons, http://www.callawaygolf.com/golf-clubs/iron-sets/irons-2016-big-bertha-os.html accessed May 4, 2018.
(Continued)

*Primary Examiner* — Sebastiano Passaniti
(74) *Attorney, Agent, or Firm* — Kunzler Bean & Adamson

(57) ABSTRACT

Disclosed herein is an iron-type golf club head comprising a body comprising a heel portion, a sole portion, a toe portion, and a topline portion. The topline portion has a mass per unit length of between 0.09 g/mm and 0.40 g/mm. The golf club head also comprises a strike plate coupled to the body at a front portion of the golf club head and a cavity defined between the topline portion, the sole portion, and the strike plate. The golf club head further comprises a bridge bar at a rear portion of the golf club head. The bridge bar spans the cavity, is spaced apart from the strike plate, and is rigidly fixed to and extends uprightly between the sole portion and the topline portion. The bridge bar has a mass per unit length of between 0.09 g/mm and 0.40 g/mm.

24 Claims, 30 Drawing Sheets

Related U.S. Application Data continuation of application No. 15/859,274, filed on Dec. 29, 2017, now Pat. No. 10,493,336, which is a continuation-in-part of application No. 15/649,508, filed on Jul. 13, 2017, now Pat. No. 10,493,335, which is a continuation of application No. 14/981,330, filed on Dec. 28, 2015, now Pat. No. 9,731,176, which is a continuation-in-part of application No. 14/843,856, filed on Sep. 2, 2015, now Pat. No. 9,849,348.

(60) Provisional application No. 62/099,012, filed on Dec. 31, 2014, provisional application No. 62/098,707, filed on Dec. 31, 2014.

(51) Int. Cl.
*A63B 60/00* (2015.01)
*A63B 60/52* (2015.01)

(52) U.S. Cl.
CPC ..... *A63B 60/52* (2015.10); *A63B 53/023* (2020.08); *A63B 53/0408* (2020.08); *A63B 53/0433* (2020.08); *A63B 53/0437* (2020.08); *A63B 53/045* (2020.08); *A63B 60/002* (2020.08)

(58) Field of Classification Search
CPC ..... A63B 53/045; A63B 53/0408; A63B 53/0433; A63B 53/0437; A63B 60/002
USPC ..... 473/324–350, 287–292
See application file for complete search history.

(56) References Cited

U.S. PATENT DOCUMENTS

| | | | |
|---|---|---|---|
| 4,826,172 | A | 5/1989 | Antonious |
| 4,883,274 | A | 11/1989 | Hsien |
| 4,964,640 | A | 10/1990 | Nakanishi et al. |
| 5,090,702 | A | 2/1992 | Viste |
| 5,184,823 | A | 2/1993 | Desboilles et al. |
| 5,328,184 | A | 7/1994 | Antonious |
| 5,348,302 | A | 9/1994 | Sasamoto et al. |
| 5,472,201 | A | 12/1995 | Aizawa et al. |
| 5,489,097 | A | 2/1996 | Simmons |
| 5,492,327 | A | 2/1996 | Biafore |
| 5,522,593 | A | 6/1996 | Kobayashi et al. |
| 5,544,885 | A | 8/1996 | Besnard et al. |
| 5,833,551 | A | 11/1998 | Vincent et al. |
| 6,015,354 | A | 1/2000 | Ahn et al. |
| 6,811,496 | B2 | 11/2004 | Wahl et al. |
| 6,942,580 | B2 | 9/2005 | Hou et al. |
| 7,022,033 | B2 | 4/2006 | Bamber |
| 7,121,958 | B2 | 10/2006 | Cheng et al. |
| 7,153,219 | B2 | 12/2006 | Reed et al. |
| 7,182,698 | B2 | 2/2007 | Tseng |
| 7,232,381 | B2 | 6/2007 | Imamoto et al. |
| 7,303,485 | B2 | 12/2007 | Tseng |
| 7,585,233 | B2 | 9/2009 | Horacek et al. |
| 7,591,735 | B2 | 9/2009 | Matsunaga et al. |
| 7,662,051 | B2 | 2/2010 | Chen |
| 7,744,486 | B2 | 6/2010 | Hou et al. |
| 7,938,736 | B2 | 5/2011 | Park et al. |
| 7,963,861 | B2 | 6/2011 | Beach et al. |
| 8,012,040 | B2 | 9/2011 | Takechi |
| 8,083,612 | B2 | 12/2011 | Stites et al. |
| 8,088,025 | B2 | 1/2012 | Wahl et al. |
| 8,202,174 | B2 | 6/2012 | Breier et al. |
| 8,246,486 | B2 | 8/2012 | Sukman |
| 8,353,784 | B2 | 1/2013 | Boyd et al. |
| 8,353,786 | B2 | 1/2013 | Beach et al. |
| 8,480,506 | B2 | 7/2013 | Saracco et al. |
| 8,535,176 | B2 | 9/2013 | Bazzel et al. |
| 8,690,709 | B2 | 4/2014 | Oldknow et al. |
| 8,758,159 | B2 | 6/2014 | Morin et al. |
| 9,044,653 | B2 | 6/2015 | Wahl et al. |
| 9,138,622 | B1 | 9/2015 | Demille et al. |
| 9,492,722 | B2 | 11/2016 | Taylor et al. |
| 9,517,393 | B2 | 12/2016 | Cardani et al. |
| 9,616,305 | B2 | 4/2017 | Hettinger et al. |
| 9,731,176 | B2 | 8/2017 | Issertell et al. |
| 9,849,348 | B2 | 12/2017 | Beach et al. |
| 10,493,335 | B2 | 12/2019 | Issertell et al. |
| 10,493,336 | B2 | 12/2019 | Taylor et al. |
| 11,338,183 | B2 * | 5/2022 | Taylor ..... A63B 53/02 |
| 2001/0044345 | A1 | 11/2001 | Stites et al. |
| 2004/0082401 | A1 | 9/2004 | Takeda |
| 2005/0245325 | A1 | 11/2005 | Gilbert et al. |
| 2007/0042833 | A1 | 2/2007 | Gilbert et al. |
| 2007/0117653 | A1 | 5/2007 | Yoneyama |
| 2011/0070973 | A1 | 3/2011 | Oldknow et al. |
| 2011/0275451 | A1 | 11/2011 | Chao et al. |
| 2012/0202615 | A1 | 8/2012 | Beach et al. |
| 2013/0165257 | A1 | 6/2013 | Dipert et al. |
| 2013/0331201 | A1 | 12/2013 | Wahl et al. |
| 2016/0193508 | A1 | 7/2016 | Issertell et al. |
| 2017/0259128 | A1 | 9/2017 | Greensmith et al. |
| 2018/0185717 | A1 | 7/2018 | Demkowski et al. |

OTHER PUBLICATIONS

U.S. Appl. No. 15/706,632, filed Sep. 15, 2017.

* cited by examiner

IRON-TYPE GOLF CLUB HEAD

CROSS-REFERENCE TO RELATED APPLICATIONS

This application is a continuation of U.S. patent application Ser. No. 16/673,701, filed Jul. 13, 2017, is a continuation of U.S. patent application Ser. No. 15/859,274, filed Dec. 29, 2017, which is a continuation-in-part of U.S. patent application Ser. No. 15/649,508, filed Jul. 13, 2017, which is a continuation of U.S. Pat. No. 9,731,176, issued Aug. 15, 2017, which is a continuation-in-part of U.S. patent application Ser. No. 14/843,856, filed Sep. 2, 2015, and which claims the benefit of U.S. Provisional Patent Application No. 62/099,012, filed on Dec. 31, 2014, and U.S. Provisional Patent Application No. 62/098,707, filed on Dec. 31, 2014, all of which are incorporated herein by reference in their entireties. This application additionally references U.S. patent application Ser. No. 15/706,632, filed Sep. 15, 2017, which is a continuation-in-part of U.S. patent application Ser. No. 15/394,549, filed Dec. 29, 2016, both of which are incorporated herein by reference in their entireties. This application also references U.S. patent application Ser. No. 14/145,761, filed Dec. 31, 2013, which claims priority to U.S. Provisional Patent Application No. 61/903,185, filed Nov. 12, 2013, both of which are hereby incorporated by reference herein in their entireties. This application further references U.S. patent application Ser. No. 13/830,293, filed Mar. 14, 2013, which claims priority to U.S. Provisional Patent Application No. 61/657,675, filed Jun. 8, 2012, both of which are hereby incorporated by reference herein in their entireties. This application additionally references U.S. Pat. No. 8,353,786, filed Dec. 28, 2007, which is incorporated by reference herein in its entirety.

FIELD

This disclosure relates generally to iron-type golf club heads, and more particularly to iron-type golf club heads with an acoustic mode altering and dampening bridge bar.

BACKGROUND

The performance of golf equipment is continuously advancing due to the development of innovative clubs and club designs. While all clubs in a golfer's bag are important, both scratch and novice golfers rely on the performance and feel of iron-type golf clubs ("irons") for many commonly encountered playing situations.

Irons are generally configured in a set that includes clubs of varying loft, with shaft lengths and club head weights selected to maintain an approximately constant "swing weight" so that the golfer perceives a common "feel" or "balance" in swinging both the low-lofted irons and high-lofted irons in a set. The size of an iron's "sweet spot" is generally related to the size (i.e., surface area) of the iron's strike face, and iron sets are available with oversize club heads to provide a large sweet spot that is desirable to many golfers.

Conventional "blade" type irons have been largely displaced (especially for novice golfers) by so-called "perimeter weighted" irons, which include "cavity-back" and "hollow" iron designs. Cavity-back irons have an open cavity directly behind the strike plate, which permits club head mass to be distributed about the perimeter of the strike plate. Such cavity-back irons tend to be more forgiving to off-center hits. Hollow irons have features similar to cavity-back irons, but the cavity is enclosed by a rear wall to form a hollow region behind the strike plate. Perimeter weighted, cavity-back, and hollow iron designs permit club designers to redistribute club head mass to achieve intended playing characteristics associated with, for example, placement of a center of gravity ("CG") or a moment of inertia ("MOI") of the golf club head.

In addition, even with perimeter weighting, significant portions of the club head mass, such as the mass associated with the hosel, topline, or strike plate, are unavailable for redistribution. For example, the strike plate must withstand repeated strikes both on the driving range and on the course, requiring significant strength for durability.

Golf club manufacturers are consistently attempting to design golf clubs that are easier to hit and offer golfers greater forgiveness, such as when the ball is not struck directly at a "sweet spot" or center face of the strike face. As those skilled in the art will appreciate, many golf club head designs have been developed and proposed for assisting golfers in learning and mastering the game of golf.

With regard to iron-type club heads, cavity-back club heads have been developed. Cavity-back golf clubs shift the weight of the club head toward the outer perimeter of the club head. By shifting the weight in this manner, the CG of the club head is pushed toward the sole of the club head, thereby providing a club head that promotes better performance. In addition, weight is shifted to the toe and heel of the club head, which helps to expand the sweet spot and minimize negative performance characteristics associated with off-center strikes of a golf ball.

Shifting weight to the sole of the club head lowers the CG of the club head resulting in a golf club that launches the ball more easily and with greater backspin. Golf club designers often focus on the vertical CG of the golf club relative to the ground when the golf club is soled and in a proper address position. This vertical CG measurement is often referred to as Zup or Z-up or CG Z-up. Decreasing Z-up is preferable to increasing Z-up. Golf club designers seek to achieve a low Z-up both for golf clubs designed for low handicap golfers and high handicap golfers. For example, a low Z-up helps to maintain similar launch angles, but increases ball speed and distance, for low handicap golfers or a low Z-up helps to launch the ball more easily in the air for high handicap golfers. Additionally, placing weight at the toe increases the MOI of the golf club resulting in a golf club that resists twisting and is thereby easier to hit straight even on mishits.

As club manufacturers have learned to assist golfers by shifting the CG toward the sole of the club head, a wide variety of designs have been developed. Unfortunately, many of these designs shift the center of gravity toward the sole and perimeter of the club head at the expense of the appearance of the club head. For example, one method of lowering the CG is to simply decrease the face height at the toe and make it closer in height to the face height at the heel of the club resulting in a very untraditional looking club. This is highly undesirable as golfers have become familiar with a certain traditional style of club head and alteration of that style often adversely affects their mental outlook when addressing a ball prior to strike the ball. As such, a need exists for an improved club head which achieves the goal of shifting the CG further toward the sole and perimeter of the club head without substantially altering the appearance of a traditional cavity-back club head.

Unfortunately, the acoustical properties of a golf club head may be negatively impacted by relocating mass and lowering Z-up on the golf club head. The acoustical properties of golf club heads (e.g., the sound the golf club head generates upon impact with a golf ball) affect the overall feel of the golf club by providing instant auditory feedback to the user of the golf club. For example, the auditory feedback can provide an indication as to how well the golf ball was struck by the club, thereby promoting user confidence.

The sound generated by a golf club is based on the rate, or frequency, at which the golf club head vibrates and the duration of the vibration upon impact with a golf ball. Generally, for iron-type golf clubs, a desired first mode frequency is generally around 3,000 Hz and preferably greater than 3,200 Hz. Additionally, the duration of the first mode frequency is important because a longer duration may feel like a golf ball was poorly struck, which results in less confidence for the golfer even when the golf ball was well struck. Generally, for iron-type golf club heads, a desired first mode frequency duration is generally less than 10 ms and preferably less than 7 ms. Some conventional golf club heads employ features designed to increase the vibrational frequency of the golf club head and decrease the frequency duration of the golf club head. However, such features may fail to increase the vibration frequency of the golf club heads to desirable levels (e.g., a desirable upward shift in the vibration frequency) and/or decrease the frequency duration to desirable level.

Additionally, the coefficient of restitution ("COR") of a golf club head may be negatively impacted by relocating mass and lowering Z-up on the golf club head. The COR of a golf club head is a measurement of the energy loss or retention when the golf ball is impact by the golf club head. Generally, the higher the COR, the more efficient the transfer of energy from the golf club head to the golf ball and the longer the golf shot. For some conventional golf club heads, lowering the Z-up of the golf club head results in an undesirable lowering of the COR.

Conventional iron-type golf club heads may not achieve desired first and fourth mode frequencies and frequency durations and desired COR characteristics while providing the performance benefits afforded by a low Z-up. Accordingly, it would be desirable to provide a golf club head that lowers the Z-up while maintaining desirable vibration frequency and duration characteristics and a desirable COR.

SUMMARY

The subject matter of the present application has been developed in response to the present state of the art, and in particular, in response to the shortcomings of conventional iron-type golf club heads, that have not yet been fully solved by currently available techniques. Accordingly, the subject matter of the present application has been developed to provide an iron-type golf club head that overcomes at least some of the above-discussed shortcomings of prior art techniques. More specifically, described herein are embodiments of an iron-type golf club head that lowers the Z-up while maintaining desirable vibration frequency and duration characteristics and a desirable COR.

Disclosed herein is an iron-type golf club head comprising a body comprising a heel portion, a sole portion, a toe portion, and a topline portion. The topline portion has a mass per unit length of between 0.09 g/mm and 0.40 g/mm. The golf club head also comprises a strike plate coupled to the body at a front portion of the golf club head and a cavity defined between the topline portion, the sole portion, and the strike plate. The golf club head further comprises a stiffening member or bridge bar at a rear portion of the golf club head. The bridge bar spans the cavity, is spaced apart from the strike plate, and is rigidly fixed to and extends uprightly between the sole portion and the topline portion. The bridge bar has a mass per unit length of between 0.09 g/mm and 0.40 g/mm. The preceding subject matter of this paragraph characterizes example 1 of the present disclosure.

A Z-up of the golf club head is below about 20 mm. The topline portion comprises weight reducing features that shift a Z-up of the golf club head downward by at least 0.4 mm. The bridge bar shifts the Z-up of the golf club head upward by less than 2.0 mm. The preceding subject matter of this paragraph characterizes example 2 of the present disclosure, wherein example 2 also includes the subject matter according to example 1, above.

The weight reducing features shift the Z-up of the golf club head downward by at least 1.0 mm. The preceding subject matter of this paragraph characterizes example 3 of the present disclosure, wherein example 3 also includes the subject matter according to example 2, above.

The topline portion comprises weight reducing and stiffening features comprising a rearwardly and downwardly directed overhang and a plurality of ribs coupled to an underside of the overhang. The preceding subject matter of this paragraph characterizes example 4 of the present disclosure, wherein example 4 also includes the subject matter according to any one of examples 1-3, above.

The bridge bar is fixed to one rib of the plurality of ribs. The preceding subject matter of this paragraph characterizes example 5 of the present disclosure, wherein example 5 also includes the subject matter according to example 4, above.

The bridge bar is hollow. The preceding subject matter of this paragraph characterizes example 6 of the present disclosure, wherein example 6 also includes the subject matter according to any one of examples 1-5, above.

The bridge bar comprises at least one web and at least one flange angled relative to the at least one web. The preceding subject matter of this paragraph characterizes example 7 of the present disclosure, wherein example 7 also includes the subject matter according to any one of examples 1-6, above.

A cross-section of the bridge bar is T-shaped. The preceding subject matter of this paragraph characterizes example 8 of the present disclosure, wherein example 8 also includes the subject matter according to any one of examples 1-7, above.

The bridge bar has a mass per unit length of between 0.09 g/mm and 0.25 g/mm. The preceding subject matter of this paragraph characterizes example 9 of the present disclosure, wherein example 9 also includes the subject matter according to any one of examples 1-8, above.

The golf club head has a coefficient of restitution (COR) greater than 0.79. The preceding subject matter of this paragraph characterizes example 10 of the present disclosure, wherein example 10 also includes the subject matter according to any one of examples 1-9, above.

A Z-up of the golf club head is below about 20 mm. The preceding subject matter of this paragraph characterizes example 11 of the present disclosure, wherein example 11 also includes the subject matter according to any one of examples 1-10, above.

A Z-up of the golf club head is below about 18 mm. The preceding subject matter of this paragraph characterizes example 12 of the present disclosure, wherein example 12 also includes the subject matter according to example 11, above.

The golf club head further comprises a channel formed in the sole portion and extending substantially parallel to the strike plate. The preceding subject matter of this paragraph characterizes example 13 of the present disclosure, wherein example 13 also includes the subject matter according to any one of examples 1-12, above.

The strike plate has a minimum thickness less than or equal to 2 mm. The preceding subject matter of this paragraph characterizes example 14 of the present disclosure, wherein example 14 also includes the subject matter according to any one of examples 1-13, above.

The golf club head further comprises a rear panel adjacent the bridge bar and covering the cavity. The rear panel is made of a material different than the bridge bar. The preceding subject matter of this paragraph characterizes example 15 of the present disclosure, wherein example 15 also includes the subject matter according to any one of examples 1-14, above.

The bridge bar is made of a metal alloy and the rear panel is made of a non-metal material having a density between 1 g/cc and 2 g/cc. The preceding subject matter of this paragraph characterizes example 16 of the present disclosure, wherein example 16 also includes the subject matter according to example 15, above.

The non-metal material is a fiber-reinforced polymer. The preceding subject matter of this paragraph characterizes example 17 of the present disclosure, wherein example 17 also includes the subject matter according to example 16, above.

An areal mass of the rear portion of the golf club head between the topline portion, the sole portion, the toe portion, and the heel portion is between 0.0005 g/mm2 and 0.00925 g/mm2. The preceding subject matter of this paragraph characterizes example 18 of the present disclosure, wherein example 18 also includes the subject matter according to any one of examples 1-17, above.

Also disclosed herein is an iron-type golf club head comprising a body comprising a heel portion, a sole portion, a toe portion, and a topline portion. The golf club head also comprises a strike plate coupled to the body at a front portion of the golf club head, a cavity defined between the topline portion, the sole portion, and the strike plate, and a bridge bar at a rear portion of the golf club head. The bridge bar spans the cavity, is spaced apart from the strike plate, and is rigidly fixed to and extends uprightly between the sole portion and the topline portion. The bridge bar has a mass per unit length of between 0.09 g/mm and 0.40 g/mm. Furthermore, the bridge bar increases a frequency, at which a maximum displacement of at least one location of a plurality of locations along the topline portion occurs, by at least 100 Hz. The preceding subject matter of this paragraph characterizes example 19 of the present disclosure.

The bridge bar increases the frequency by at least 400 Hz. The preceding subject matter of this paragraph characterizes example 20 of the present disclosure, wherein example 20 also includes the subject matter according to example 19, above.

A first lowest frequency, at which a first maximum displacement of at least one location of the plurality of locations along the topline portion occurs, is at least 3,500 Hz. The preceding subject matter of this paragraph characterizes example 21 of the present disclosure, wherein example 21 also includes the subject matter according to any one of examples 19 or 20, above.

A fourth lowest frequency, at which a fourth maximum displacement of the at least one location of the plurality of locations along the topline portion occurs, is at least 6,000 Hz. The preceding subject matter of this paragraph characterizes example 22 of the present disclosure, wherein example 22 also includes the subject matter according to example 21, above.

Further disclosed herein is an iron-type golf club head comprising a body comprising a heel portion, a sole portion, a toe portion, and a topline portion. The golf club head further comprises a strike plate coupled to the body at a front portion of the golf club head and a cavity defined between the topline portion, the sole portion, and the strike plate. The golf club head further comprises a bridge bar at a rear portion of the golf club head. The bridge bar spans the cavity, is spaced apart from the strike plate, and is rigidly fixed to and extends uprightly between the sole portion and the topline portion. The bridge bar has a mass per unit length of between 0.09 g/mm and 0.40 g/mm. The iron-type golf club head with the bridge bar has a first frequency at which a first maximum displacement occurs, a second frequency at which a second maximum displacement occurs, a third frequency at which a third maximum displacement occurs, and a fourth frequency at which a fourth maximum displacement occurs. Removing the bridge bar decreases at least one of the first frequency, the second frequency, the third frequency, and the fourth frequency by at least 200 Hz. The preceding subject matter of this paragraph characterizes example 23 of the present disclosure.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other instances, additional features and advantages may be recognized in certain embodiments and/or implementations that may not be present in all embodiments or implementations. Further, in some instances, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which.

DETAILED DESCRIPTION

The present disclosure describes iron-type golf club heads that include a body and a strike plate. The body includes a heel portion, a toe portion, a topline portion, a sole portion, and a hosel configured to attach the club head to a shaft to form a golf club. In various embodiments, the body defines a front opening configured to receive the strike plate at a front rim formed around a periphery of the front opening. In various other embodiments, the strike plate is formed integrally (such as by casting) with the body. The body further includes a bridge bar that spans between and is fixed to the topline portion and the sole portion along a rear of the body. The particular configuration of the bridge bar, in conjunction with other features of the body, helps to promote a higher or upward shift in modal frequency of the golf club head while providing a desirably high COR and low Z-up.

Figure 1:
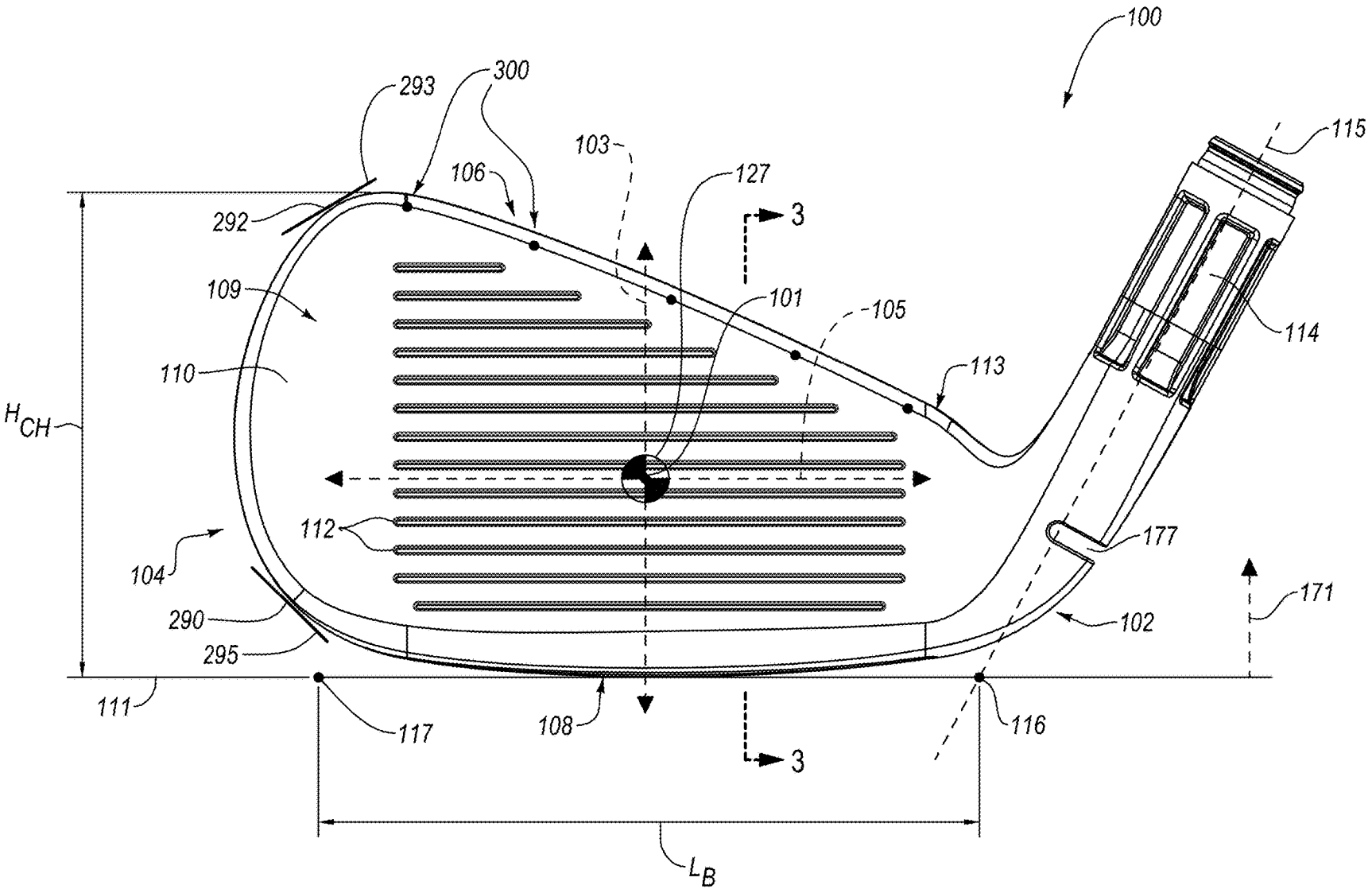
FIG. 1 is a front elevation view of a golf club head, according to one or more examples of the present disclosure.

FIG. 1 illustrates one embodiment of an iron-type golf club head 100 including a body 113 having a heel portion 102, a toe portion 104, a sole portion 108, a topline portion 106, and a hosel 114. The golf club head 100 is shown in FIG. 1 in a normal address position with the sole portion 108 resting upon a ground plane 111, which is assumed to be perfectly flat. As used herein, "normal address position" means the position of the golf club head 100 when a vector normal to a geometric center of a strike face 110 of the golf club head 100 lies substantially in a first vertical plane (i.e., a plane perpendicular to the ground plane 111), a centerline axis 115 of the hosel 114 lies substantially in a second vertical plane, and the first vertical plane and the second vertical plane substantially perpendicularly intersect. The geometric center of the strike face 110 is determined using the procedures described in the USGA "Procedure for Measuring the Flexibility of a Golf Club head," Revision 2.0, Mar. 25, 2005. The strike face 110 is the front surface of a strike plate 109 of the golf club head 100. The strike face 110 has a rear surface 131, opposite the strike face 110 (see, e.g., FIG. 3). In some embodiments, the strike plate has a thickness that is less than 2.0 mm, such as between 1.0 mm and 1.75 mm. Additionally or alternatively, the strike plate may have an average thickness less than or equal to 2 mm, such as an average thickness between 1.0 mm and 2.0 mm, such as an average thickness between 1.25 mm and 1.75 mm. In some embodiments, the strike plate has a thickness that varies. In some embodiments, the strike plate has a thinned region coinciding and surrounding the center of the face such that the center face region of the strike plate is the thinnest region of the strike plate. In other embodiments, the strike plate has a thickened region coinciding and surrounding the center of the face such that the center face region of the strike plate is the thickest region of the strike plate.

As shown in FIG. 1, a lower tangent point 290 on the outer surface of the golf club head 100, of a line 295 forming a 45° angle relative to the ground plane 111, defines a demarcation boundary between the sole portion 108 and the toe portion 104. Similarly, an upper tangent point 292 on the outer surface of the golf club head 100 of a line 293 forming a 45° angle relative to the ground plane 111 defines a demarcation boundary between the topline portion 106 and the toe portion 104. In other words, the portion of the golf club head 100 that is above and to the left (as viewed in FIG. 1) of the lower tangent point 290 and below and to the left (as viewed in FIG. 1) of the upper tangent point 292 is the toe portion 104.

The strike face 110 includes grooves 112 designed to impact and affect spin characteristics of a golf ball struck by the golf club head 100. In some embodiments, the toe portion 104 may be defined to be any portion of the golf club head 100 that is toeward of the grooves 112. In some embodiments, the body 113 and the strike plate 109 of the golf club head 100 can be a single unitary cast piece, while in other embodiments, the strike plate 109 can be formed separately and be adhesively or mechanically attached to the body 113 of the golf club head 100.

Figure 2:
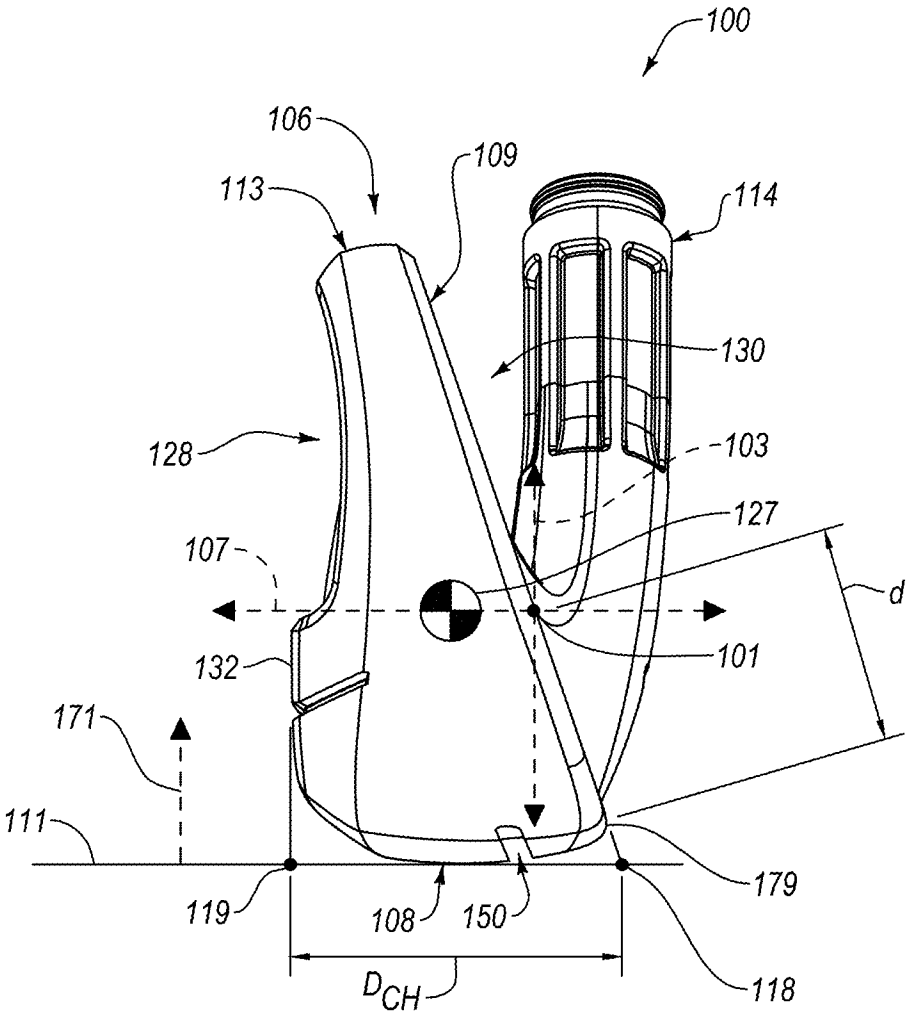
FIG. 2 is a side elevation view of the golf club head of FIG. 1, according to one or more examples of the present disclosure.

FIGS. 1 and 2 show an ideal strike location 101 on the strike face 110 and respective coordinate system with the ideal strike location 101 at the origin. As used herein, the ideal strike location 101 is located on the strike face 110 and coincides with the location of the CG 127 of the golf club head 100 along an x-axis 105 and is offset from a leading edge 179 of the golf club head 100 (defined as the midpoint of a radius connecting the sole portion 108 and the strike face 110) by a distance d, which is 16.5 mm in some implementations, along the strike face 110, as shown in FIG. 2. The x-axis 105, a y-axis 107, and a z-axis 103 intersect at the ideal strike location 101, which defines the origin of the orthogonal axes. With the golf club head 100 in the normal address position, the x-axis 105 is parallel to the ground plane 111 and is oriented perpendicular to a normal extending from the strike face 110 at the ideal strike location 101. The y-axis 107 is also parallel to the ground plane 11 and is perpendicular to the x-axis 105. The z-axis 103 is oriented perpendicular to the ground plane 11, and thus is perpendicular to the x-axis 105 and the y-axis 107. In addition, a z-up axis 171 can be defined as an axis perpendicular to the ground plane 111 and having an origin at the ground plane 111.

In certain embodiments, a desirable CG-y location is between about 0.25 mm to about 20 mm along the y-axis 107 toward the rear portion of the club head. Additionally, according to some embodiments, a desirable CG-z location is between about 12 mm to about 25 mm along the z-up axis 171.

Figure 3:
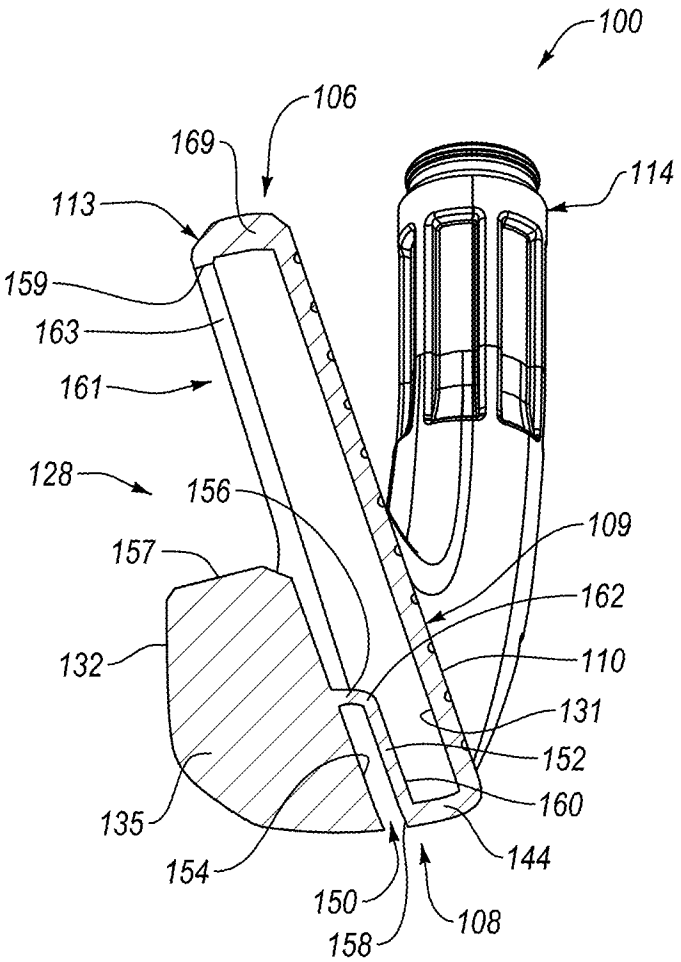
FIG. 3 is a cross-sectional side elevation view of the golf club head of FIG. 1, taken along the line 3-3 of FIG. 1, according to one or more examples of the present disclosure.
Figure 4:
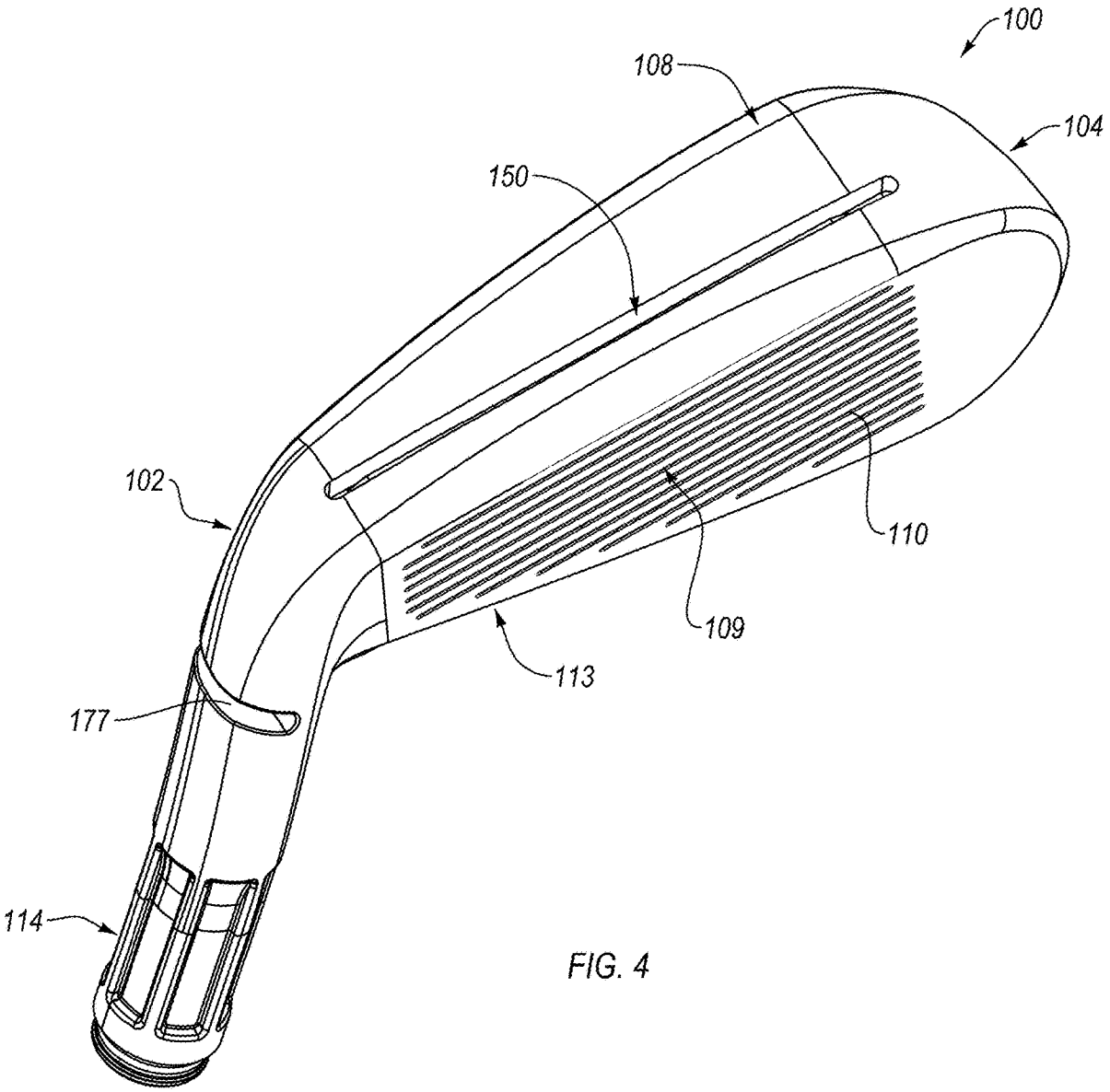
FIG. 4 is a perspective view of the golf club head of FIG. 1, from a bottom of the golf club head, according to one or more examples of the present disclosure.
Figure 5:
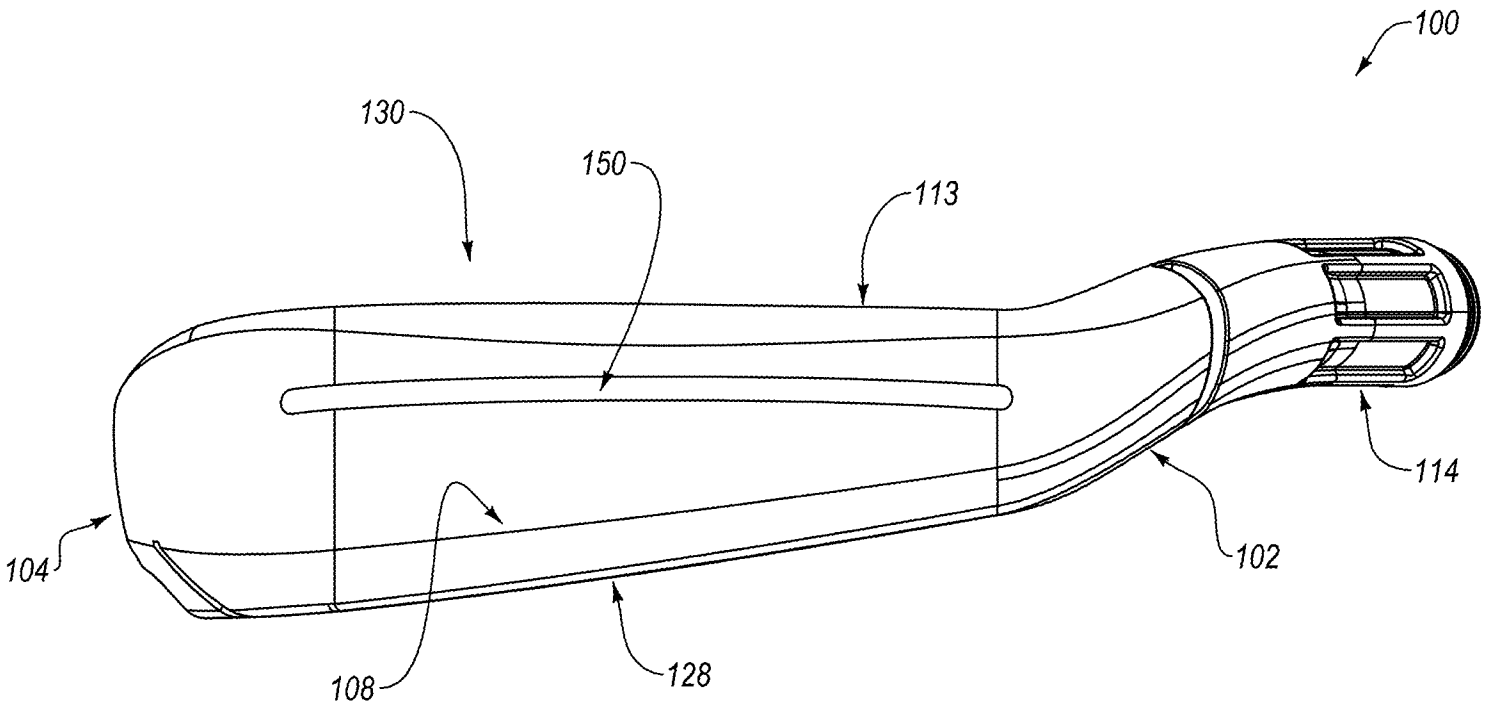
FIG. 5 is a bottom plan view of the golf club head of FIG. 1, according to one or more examples of the present disclosure.

The golf club head 100 may be of solid (also referred to as "blades" and/or "musclebacks"), hollow, cavity back, or other construction. However, in the illustrated embodiments, the golf club head 100 is depicted as having a cavity-back construction because the golf club head 100 includes an open cavity 161 behind the strike plate 109 (see, e.g., FIG. 3). FIG. 3 shows a cross-sectional side view, along the cross-section lines 3-3 of FIG. 1, of the golf club head 100.

In the embodiment shown in FIGS. 1-3, the grooves 112 are located on the strike face 110 such that they are centered along the X-axis 105 about the ideal strike location 101 (such that the ideal strike location 101 is located within the strike face 110 on an imaginary line that is both perpendicular to and that passes through the midpoint of the longest score-line groove 112). In other embodiments (not shown in the drawings), the grooves 112 may be shifted along the X-axis 105 to the toe side or the heel side relative to the ideal striking location 101, the grooves 112 may be aligned along an axis that is not parallel to the ground plane 111, the grooves 112 may have discontinuities along their lengths, or the strike face 110 may not have grooves 112. Still other shapes, alignments, and/or orientations of grooves 112 on the strike face 110 are also possible.

In reference to FIG. 1, the golf club head 100 has a sole length $L_B$ (i.e., length of the sole) and a club head height $H_{CH}$ (i.e., height of the golf club head 100). The sole length $L_B$ is defined as the distance between two points 116, 117 projected onto the ground plane 111. The heel side point 116 is defined as the intersection of a projection of the hosel axis 115 onto the ground plane 111. The toe side point 117 is defined as the intersection point of the vertical projection of the lower tangent point (described above) onto the ground plane 111. Accordingly, the distance between the heel side point 116 and the toe side point 117 is the sole length $L_B$ of the golf club head 100. The club head height $H_{CH}$ is defined as the distance between the ground plane 111 and the uppermost point of the club head in a direction parallel to the z-up axis 171.

Referring to FIG. 2, the golf club head 100 includes a club head front-to-back depth $D_{CH}$ defined as the distance between two points 118, 119 projected onto the ground plane 111. A forward end point 118 is defined as the intersection of the projection of the leading edge 143 onto the ground plane 111 in a direction parallel to the z-up axis 171. A rearward end point 119 is defined as the intersection of the projection of the rearward-most point of the club head onto the ground plane 111 in a direction parallel to the z-up axis 171. Accordingly, the distance between the forward end point 118 and rearward end point 119 of the golf club head 100 is the depth $D_{CH}$ of the golf club head 100.

Referring to FIGS. 3 and 6-9, the body 113 of the golf club head 100 further includes a sole bar 135 that defines a rearward portion of the sole portion 108 of the body 113. The sole bar 135 has a relatively large thickness in relation to the strike plate 109 and other portions of the golf club head 100. Accordingly, the sole bar 135 accounts for a significant portion of the mass of the golf club head 100 and effectively shifts the CG of the golf club head 100 relatively lower and rearward. As particularly shown in FIG. 3, the sole portion 108 of the body 113 includes a forward portion 189 with a thickness less than that of the sole bar 135. The forward portion 189 is located between the sole bar 135 and the strike face 110. As described more fully below, the body 113 includes a channel 150 formed in the sole portion 108 between the sole bar 135 and the strike face 110 to effectively separate the sole bar 135 from the strike face 110. The channel 150 is located closer to the forward end point 118 than the rearward end point 119.

In certain embodiments of the golf club head 100, such as those where the strike plate 109 is separately formed and attached to the body 113, the strike plate 109 can be formed of forged maraging steel, maraging stainless steel, or precipitation-hardened (PH) stainless steel. In general, maraging steels have high strength, toughness, and malleability. Being low in carbon, maraging steels derive their strength from precipitation of inter-metallic substances other than carbon. The principle alloying element is nickel (e.g., 15% to nearly 30%). Other alloying elements producing intermetallic precipitates in these steels include cobalt, molybdenum, and titanium. In one embodiment, the maraging steel contains 18% nickel. Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the strike plate 109. In other embodiments, the strike plate 109 is a precipitation hardened stainless steel such as 17-4, 15-5, or 17-7. After forming the strike plate 109 and the body 113 of the golf club head 100, the contact surfaces of the strike plate 109 and the body 113 can be finish-machined to ensure a good interface contact surface is provided prior to welding. In some embodiments, the contact surfaces are planar for ease of finish machining and engagement.

The strike plate 109 can be forged by hot press forging using any of the described materials in a progressive series of dies. After forging, the strike plate 109 is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 113 of the golf club head 100 is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 113 and/or the strike plate 109 of the golf club head 100 are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

Figure 20:
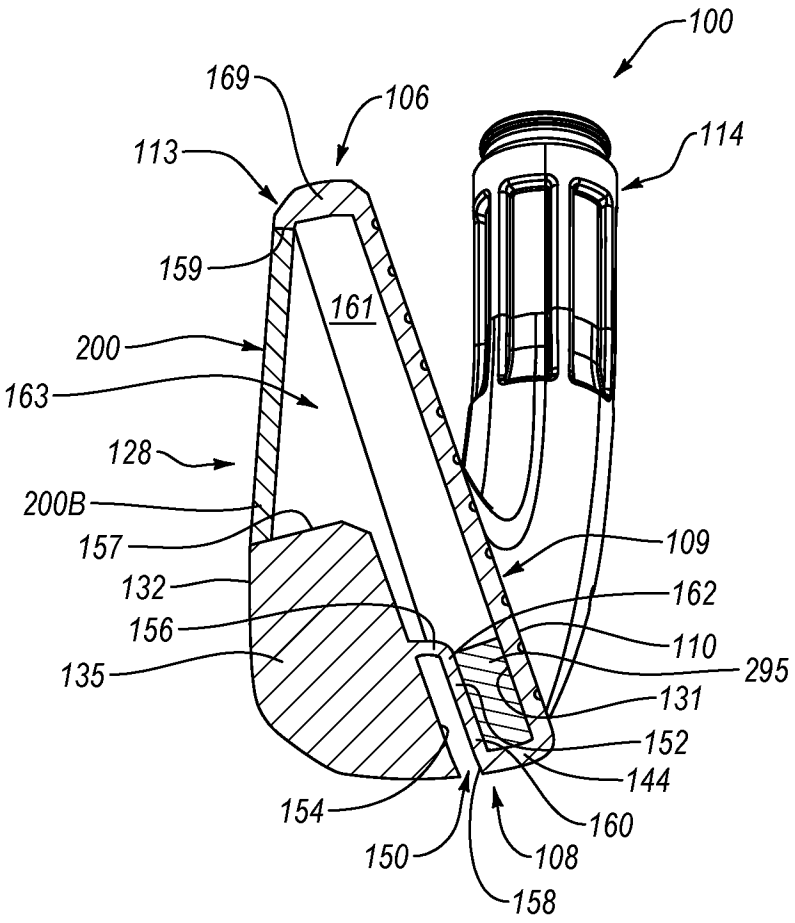
FIG. 20 is a cross-sectional side elevation view of the golf club head of FIG. 18, taken along the line 20-20 of FIG. 18, according to one or more examples of the present disclosure.
Figure 21:
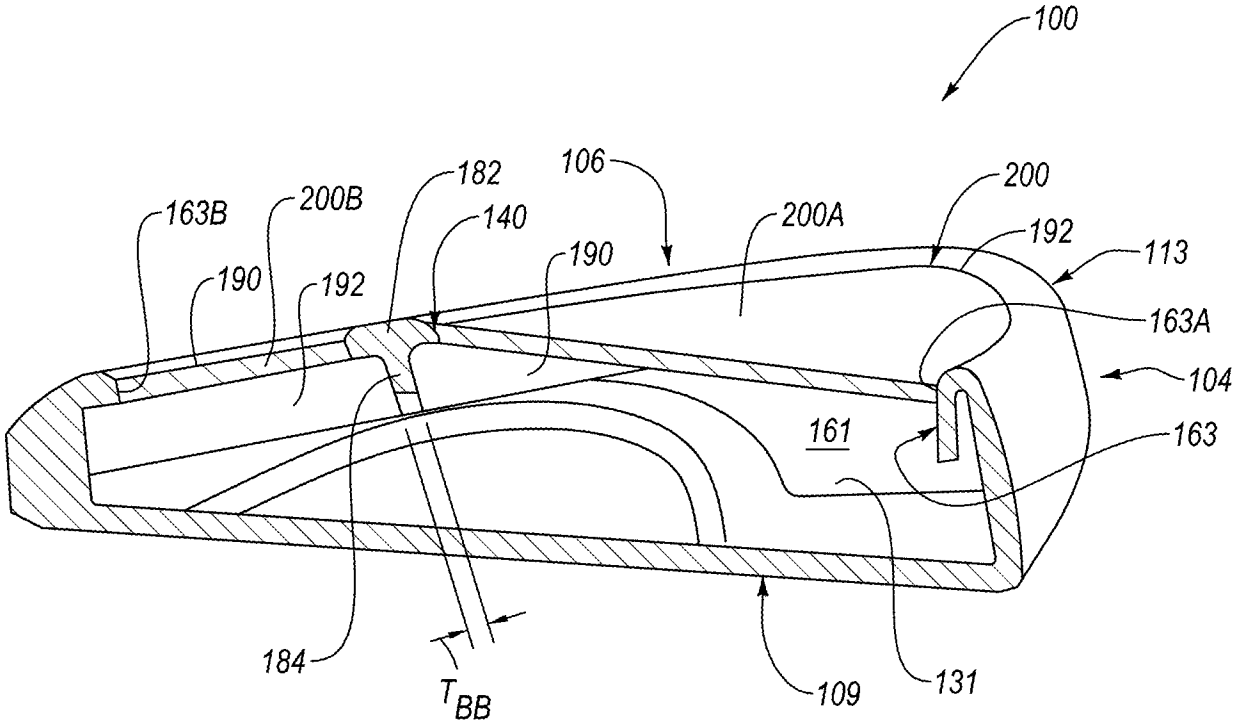
FIG. 21 is a cross-sectional bottom view of the golf club head of FIG. 18, taken along the line 21-21 of FIG. 18, according to one or more examples of the present disclosure.

The body 113 of the golf club head 100 can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements. Referring to FIG. 20, an insert 295 is located in a lower region of the cavity 161.

In some embodiments, the golf club head 100 includes a flexible boundary structure ("FBS") at one or more locations on the golf club head 100. Generally, the FBS feature is any structure that enhances the capability of an adjacent or related portion of the golf club head 100 to flex or deflect and to thereby provide a desired improvement in the performance of the golf club head 100. The FBS feature may include, in several embodiments, at least one slot, at least one channel, at least one gap, at least one thinned or weakened region, and/or at least one of any of various other structures. For example, in several embodiments, the FBS feature of the golf club head 100 is located proximate the strike face 109 of the golf club head 100 in order to enhance the deflection of the strike face 109 upon impact with a golf ball during a golf swing. The enhanced deflection of the strike face 109 may result, for example, in an increase or in a desired decrease in the coefficient of restitution ("COR") of the golf club head 100. When the FBS feature directly affects the COR of the golf club head 100, the FBS may also be termed a COR feature. In other embodiments, the increased perimeter flexibility of the strike face 109 may cause the strike face 109 to deflect in a different location and/or different manner in comparison to the deflection that occurs upon striking a golf ball in the absence of the channel, slot, or other flexible boundary structure.

In the illustrated embodiment of the golf club head 100, the FBS feature is a channel 150 that is located on the sole portion 108 of the golf club head 100. As indicated above, the FBS feature may comprise a slot, a channel, a gap, a thinned or weakened region, or other structure. For clarity, however, the descriptions herein will be limited to embodiments containing a channel, such as the channel 150, with it being understood that other FBS features may be used to achieve the benefits described herein.

Referring to FIG. 3, the channel 150 is formed into the sole portion 108 and extends generally parallel to and spaced rearwardly from the strike face 110. Moreover, the channel 150 is defined by a forward wall 152, a rearward wall 154, and an upper wall 156. The rearward wall 154 is a forward portion of the sole bar 135. The channel 150 includes an opening 158 defined on the sole portion 108 of the golf club head 100. The forward wall 152 further defines, in part, a first hinge region 160 located at the transition from the forward portion of the sole 108 to the forward wall 152, and a second hinge region 162 located at a transition from an upper region of the forward wall 152 to the sole bar 135. The first hinge region 160 and the second hinge region 162 are portions of the golf club head 100 that contribute to the increased deflection of the strike face 110 of the golf club head 100 due to the presence of the channel 150. In particular, the shape, size, and orientation of the first hinge region 160 and the second hinge region 162 are designed to allow these regions of the golf club head 100 to flex under the load of a golf ball impact. The flexing of the first hinge region 160 and second hinge region 162, in turn, creates additional deflection of the strike face 110.

Figure 12:
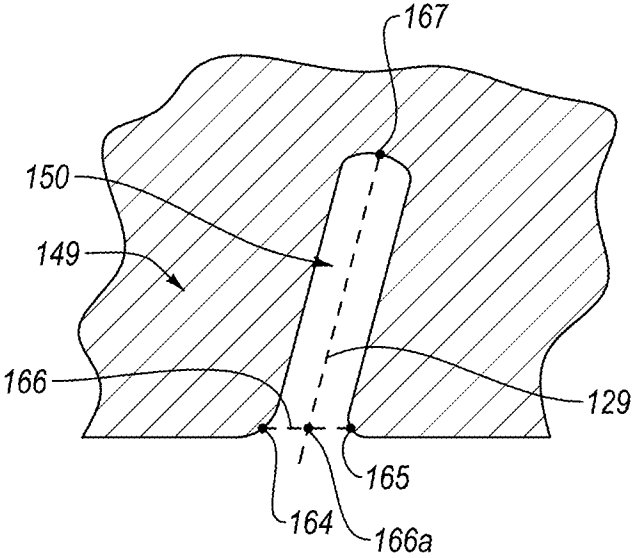
FIG. 12 is a cross-sectional side view of the channel of the sole portion of the golf club head of FIG. 1, taken along the line 3-3 of FIG. 1, according to one or more examples of the present disclosure.
Figure 13:
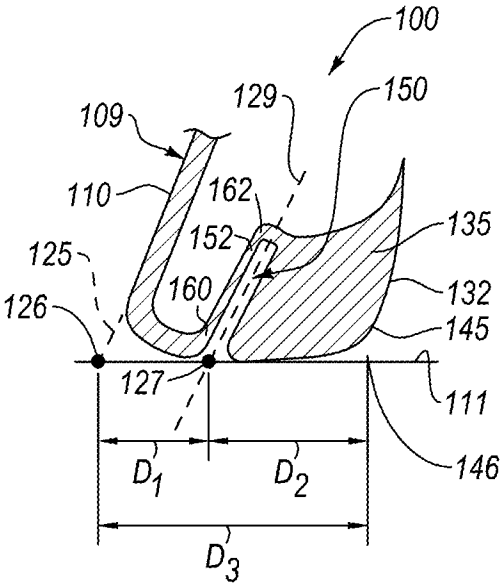
FIG. 13 is a cross-sectional side view of the channel of the sole portion of the golf club head of FIG. 1, taken along the line 3-3 of FIG. 1, according to one or more examples of the present disclosure.

Several aspects of the size, shape, and orientation of the golf club head 100 and channel 150 are illustrated in the embodiments of the golf club head 100 shown in FIGS. 11-15. For example, as shown in FIG. 13, for each cross-section of the golf club head 100 defined within a y-z plane, a face-to-channel distance $D_1$ is the distance measured on the ground plane 111 between a face plane projection point 126 and a channel centerline projection point 127. The face plane projection point 126 is defined as the intersection of a projection of the strike face 110 onto the ground plane 111. The channel centerline projection point 127 is defined as the intersection of a projection of a channel centerline 129 onto the ground plane 211.

Figure 11:
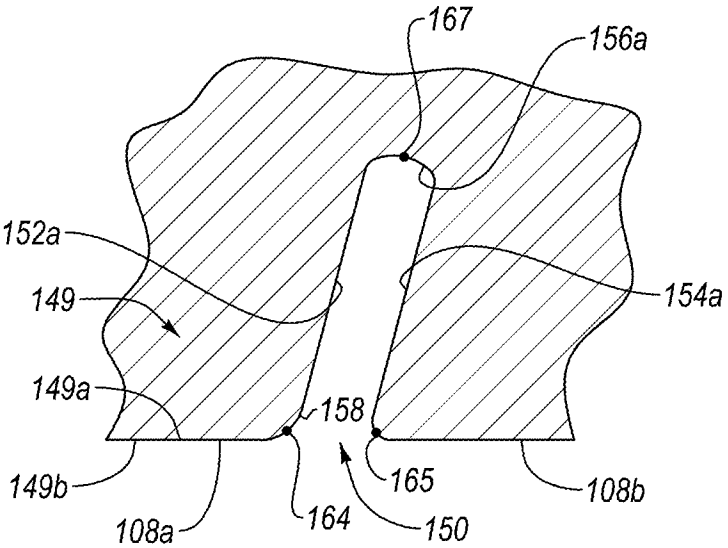
FIG. 11 is a cross-sectional side view of a channel of a sole portion of the golf club head of FIG. 1, taken along the line 3-3 of FIG. 1, according to one or more examples of the present disclosure.

Referring to FIGS. 11 and 12, a schematic profile 149 of the outer surface of a portion of the golf club head 100 that surrounds and includes the region of the channel 150 is shown. The schematic profile has an interior side 149*a* and an exterior side 149*b*. A forward sole exterior surface 108*a* extends on a forward side of the channel 150 and a rearward sole exterior surface 108*b* extends on a rearward side of the channel 150. The channel 150 has a forward wall exterior surface 152*a*, a rear wall exterior surface 154*a*, and an upper wall exterior surface 156*a*. A forward channel entry point 164 is defined as the midpoint of a curve having a local minimum radius ($r_{min}$, measured from the interior side 149*a* of the schematic profile 149) that is located between the forward sole exterior surface 108*a* and the forward wall exterior surface 152*a*. A rear channel entry point 165 is defined as the midpoint of a curve having a local minimum radius ($r_{min}$, also measured from the interior side 149*a* of the schematic profile 149) that is located between the rearward sole exterior surface 108*b* and the rear wall exterior surface 154*a*.

An imaginary line 166 that connects the forward channel entry point 164 and the rear channel entry point 165 defines the channel opening 158. A midpoint 166*a* of the imaginary line 166 is one of two points that define the channel centerline 129. The other point defining the channel centerline 129 is an upper channel peak 167, which is defined as the midpoint of a curve having a local minimum radius ($r_{min}$, as measured from the exterior side 149*b* of the schematic profile 149) that is located between the forward wall exterior surface 152*a* and the rear wall exterior surface 154*a*. In an embodiment having one or more flat segment(s) or flat surface(s) located at the upper end of the channel 150 between the forward wall 152 and the rear wall 154, the upper channel peak 167 is defined as the midpoint of the flat segment(s) or flat surface(s).

Referring to FIG. 13, another aspect of the size, shape, and orientation of the golf club head 100 and the channel 150 is the width of the sole portion 108 and corresponding sections of the sole portion 108. For example, for each cross-section of the golf club head 100 defined within the y-z plane, the sole width, $D_3$ is the distance measured on the ground plane 111 between the face plane projection point 126 and a trailing edge projection point 146. The face plane projection point 126 is defined above. The trailing edge projection point 146 is the intersection with the ground plane 111 of an imaginary vertical line passing through the trailing edge 145 of the golf club head 100. The trailing edge 145 is defined as a midpoint of a radius or a point that constitutes a transition from the sole portion 108 to a back wall 132 or other structure on the back portion 128 or rear portion of the golf club head 100.

Still another aspect of the size, shape, and orientation of the golf club head 100 and the channel 150 is the channel-to-rear distance $D_2$. For example, for each cross-section of the club head defined within the y-z plane, the channel-to-rear distance $D_2$ is the distance measured on the ground plane 111 between the channel centerline projection point 127 and the trailing edge projection point 146. As a result, for each such cross-section $D_1+D_2=D_3$. In one implementation, a ratio of an average value of the distance $D_1$ within a central region to an average value of the distance $D_3$ within the central region satisfies the following inequality: $0.15<D1/D3<0.71$. In one implementation, the distance $D_1$ is between 3.5 mm and 17 mm, between 5.5 mm and 14 mm, or between 8 mm and 11 mm, the distance $D_2$ is between 11 mm and 24 mm, between 13 mm and 22 mm, or between 15 mm and 18 mm, and the distance $D_3$ is between 15 mm and 28 mm, between 16 mm and 27 mm, or between 17 mm and 26 mm.

Figure 14:
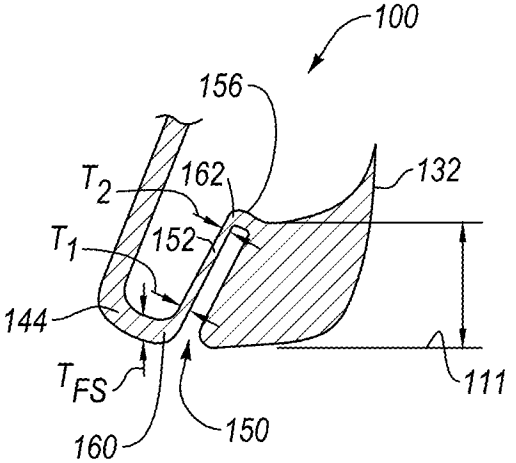
FIG. 14 is a cross-sectional side view of the channel of the sole portion of the golf club head of FIG. 1, taken along the line 3-3 of FIG. 1, according to one or more examples of the present disclosure.

Referring to FIG. 14, the forward wall 152 can have a thickness T2 near the second hinge region 162 and a thickness T1 near the first hinge region 160. The thickness T1 can be the same as or different than the thickness T2. In one implementation, the thickness T1 is between 0.5 mm and 5.0 mm, between 1.0 mm and 3.0 mm, or between 1.2 mm and 2.0 mm and the thickness T2 is between 0.5 mm and 5.0 mm, between 1.0 mm and 2.5 mm, or between 1.2 mm and 2.0 mm. In one embodiment, the thickness T1 is about 1.5 mm and the thickness T2 is about 1.5 mm. According to some implementations, a thickness $T_{FS}$ of the forward portion 189 of the sole portion 108 is between 0.5 mm and 5.0 mm, between 0.8 mm and 3.0 mm, or between 1.0 mm and 2.5. Additionally, in some implementations, a height $T_{SB}$ of the channel 150 is between 4.0 mm and 40 mm, between 5.0 mm and 30.0 mm, or between 7.0 mm and 25 mm.

Figure 15:
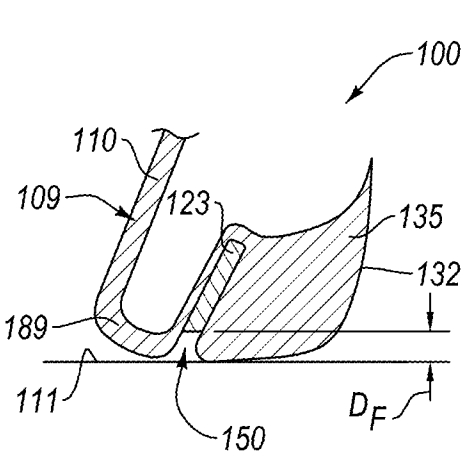
FIG. 15 is a cross-sectional side view of a channel of a sole portion of a golf club head, taken along a line similar to the line 3-3 of FIG. 1, according to one or more examples of the present disclosure.

As shown in FIG. 15, the channel 150 can be at least partially filled with a filler material 123. The filler material 123 can be any of various materials, such as thermoplastic or thermoset polymeric materials. The channel 150 can be entirely filled with the filler material 123, such that a height DF of the channel 150 not filled with filler material 123 is zero. However, in other embodiments, the height DF can be greater than zero.

The hosel 114 of the golf club head 100 can have any of various configurations, such as shown and described in U.S. Pat. No. 9,731,176. For example, the hosel 114 may be configured to reduce the mass of the hosel 114 and/or facilitate adjustability between a shaft and the golf club head 100. For example, the hosel 114 may include a notch 177 that facilitates flex between the hosel 114 and the body 113 of the golf club head 100.

Figure 9:
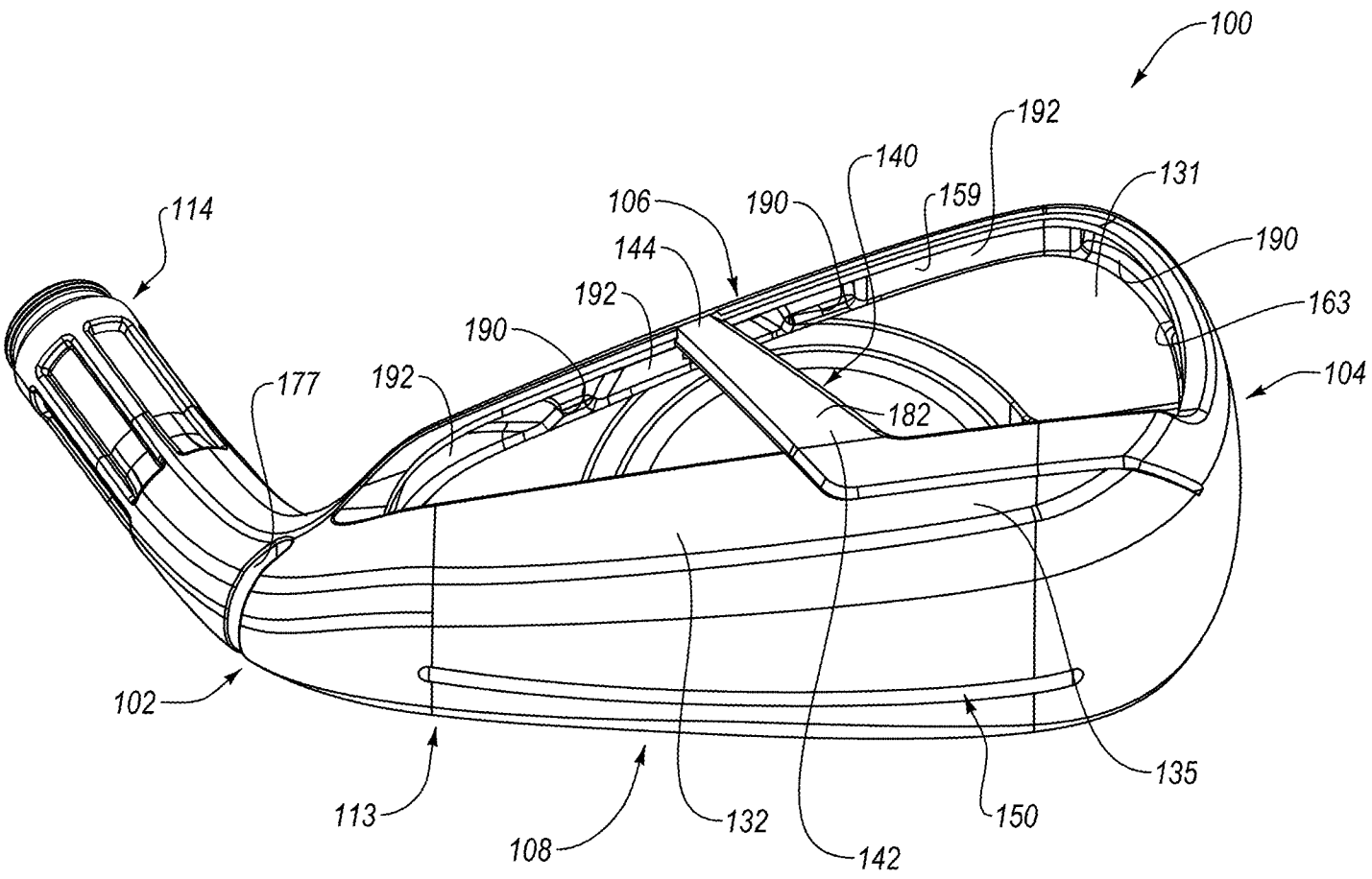
FIG. 9 is a perspective view of the golf club head of FIG. 1, from a bottom-rear of the golf club head, according to one or more examples of the present disclosure.

The topline portion 106 of the golf club head 100 can have any of various configurations, such as shown and described in U.S. Pat. No. 9,731,176. For example, the topline portion 106 of the golf club head 100 may include weight reducing features to achieve a lighter weight topline. According to one embodiment shown in FIGS. 9 and 10, the weight reducing features of the topline portion 106 of the golf club head 100 include a variable thickness of the top wall 169 defining the topline portion 106. More specifically, in a direction lengthwise along the topline portion 106, the thickness of the top wall 169 alternates between thicker and thinner so as to define pockets 190 between ribs 192 or pads. The pockets 190 are those portions of the top wall 169 having a thickness less than that of the portions of the top wall 169 defining the ribs 192. The pockets 190 help to reduce mass in the topline portion 106, while the ribs 192 promote strength and rigidity of the topline portion 106 and provide a location where a stiffening member or bridge bar 140 can be fixed to the topline portion 106 as is explained in more detail below. As shown in FIG. 9, the alternating wall thickness of the top wall 169 can extend into the toe wall forming the toe portion 104. In the illustrated embodiment, the top wall 169 includes two pockets 190 and three ribs 192. However, in other embodiments, the top wall 169 can include more or less that two pockets 190 and three ribs 192.

Referring to FIGS. 6-10, the back portion 128 of the golf club head 100 includes a bridge bar 140 that extends uprightly from the sole bar 135 to the topline portion 106. As defined herein, uprightly can be vertically or at some angle greater than zero relative to horizontal. The bridge bar 140 structurally interconnects the sole bar 135 directly with the topline portion 106 without being interconnected directly with the strike plate 109. In other words, the bridge bar 140 is directly coupled to a top surface 157 of the sole bar 135, at a top end 144 of the bridge bar 140, and a bottom surface 159 of the topline portion 106, at a bottom end 142 of the bridge bar 140. However, the bridge bar 140 is not directly coupled to the strike plate 109. In fact, an unoccupied gap or space is present between the bridge bar 140 and the rear surface 131 of the strike plate 109. The bridge bar 140 can be made of the same above-identified materials as the body 113 of the golf club head 100. Alternatively, the bridge bar 140 can be made of a material that is different than that of the rest of the body 113. However, the material of the bridge bar 140 is substantially rigid so that the portions of the golf club head 100 coupled to the bridge bar 140 are rigidly coupled. The bridge bar 140 is non-movably or rigidly fixed to the sole bar 135 and the topline portion 106. In one embodiment, the bridge bar 140 is co-formed (e.g., via a casting technique) with the topline portion 106 and the sole bar 135 so as to form a one-piece, unitary, seamless, and monolithic, construction with the topline portion 106 and the sole bar 135. However, according to another embodiment, the bridge bar 140 is formed separately from the topline portion 106 and the sole bar 135 and attached to the topline portion 106 and the bridge bar 140 using any of various attachment techniques, such as welding, bonding, fastening, and the like. In some implementations, when attached to or formed with the topline portion 106 and the sole bar 135, the bridge bar 140 is not under compression or tension.

The bridge bar 140 spans the cavity 161, and more specifically, spans an opening 163 to the cavity 161 of the golf club head 100. The opening 163 is at the back portion 128 of the golf club head 100 and has a length Lo extending between the toe portion 104 and the heel portion 102. The bridge bar 140 also has a length $L_{BB}$ and a width $W_{BB}$ transverse to the length $L_{BB}$. The length $L_{BB}$ of the bridge bar 140 is the maximum distance between the bottom end 142 of the bridge bar 140 and the top end 144 of the bridge bar 140. The length $L_{BB}$ of the bridge bar 140 is less than the length Lo. The width $W_{BB}$ of the bridge bar 140 is the minimum distance from a given point on one elongated side of the bridge bar 140 to the opposite elongated side of the bridge bar 140 in a direction substantially parallel with the x-axis 105 (e.g., heel-to-toe direction). The width $W_{BB}$ of the bridge bar 140 is less than the length Lo of the opening 163. In one implementation, the width $W_{BB}$ of the bridge bar 140 is less than 20% of the length Lo. According to another implementation, the width $W_{BB}$ of the bridge bar 140 is less than 10% or 5% of the length Lo. The width $W_{BB}$ of the bridge bar 140 can be greater at the bottom end 142 than at the top end 144 to promote a lower Z-up. Alternatively, the width $W_{BB}$ of the bridge bar 140 can be greater at the top end 144 than at the bottom end 142 to promote a higher Z-up. In yet some implementations, the width $W_{BB}$ of the bridge bar 140 is constant from the top end 144 to the bottom end 142. In some implementations, the length $L_{BB}$ of the bridge bar 140 is 2-times, 3-times, or 4-times the width $W_{BB}$ of the bridge bar 140.

Figure 6:
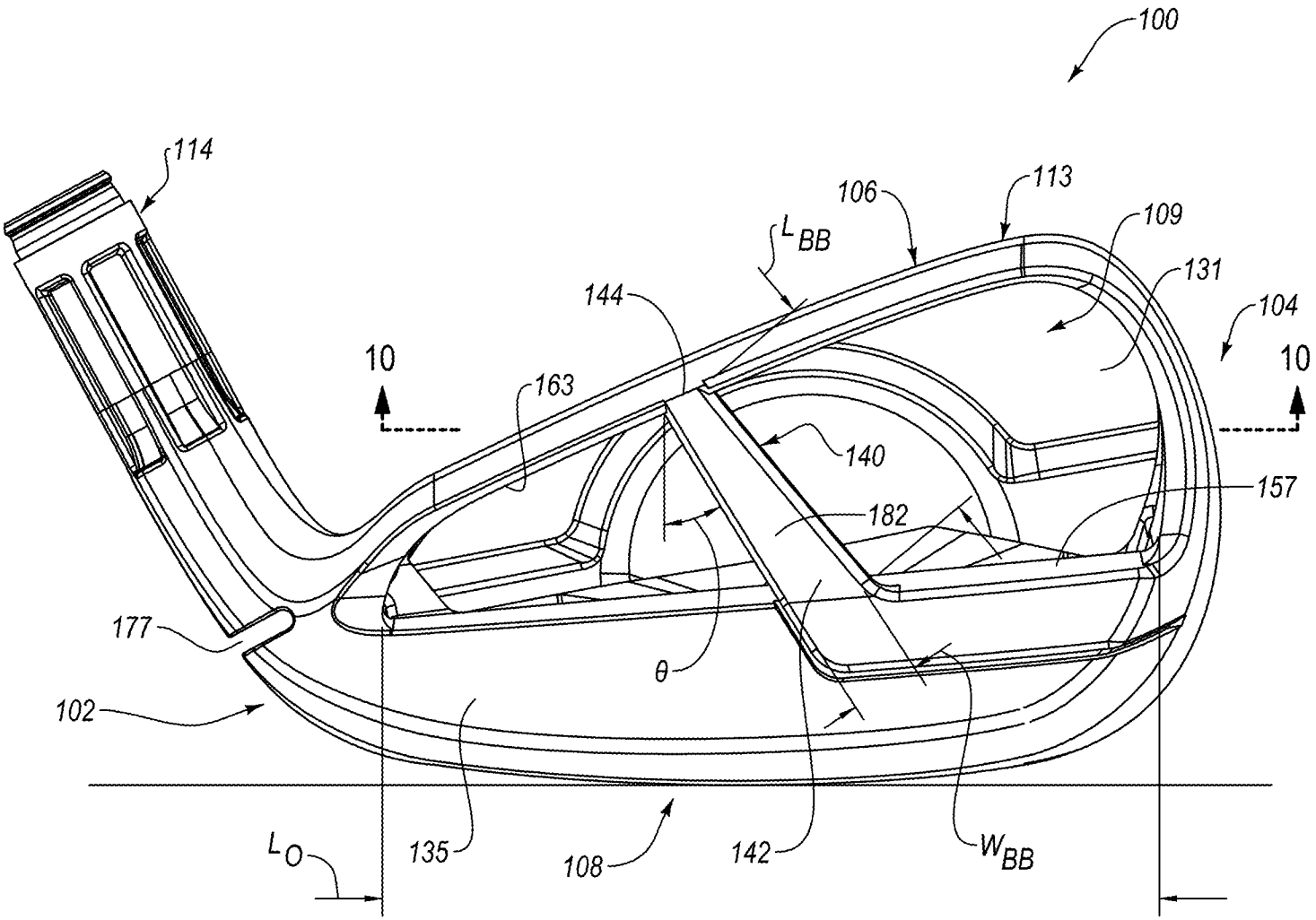
FIG. 6 is a back elevation view of the golf club head of FIG. 1, according to one or more examples of the present disclosure.
Figure 7:
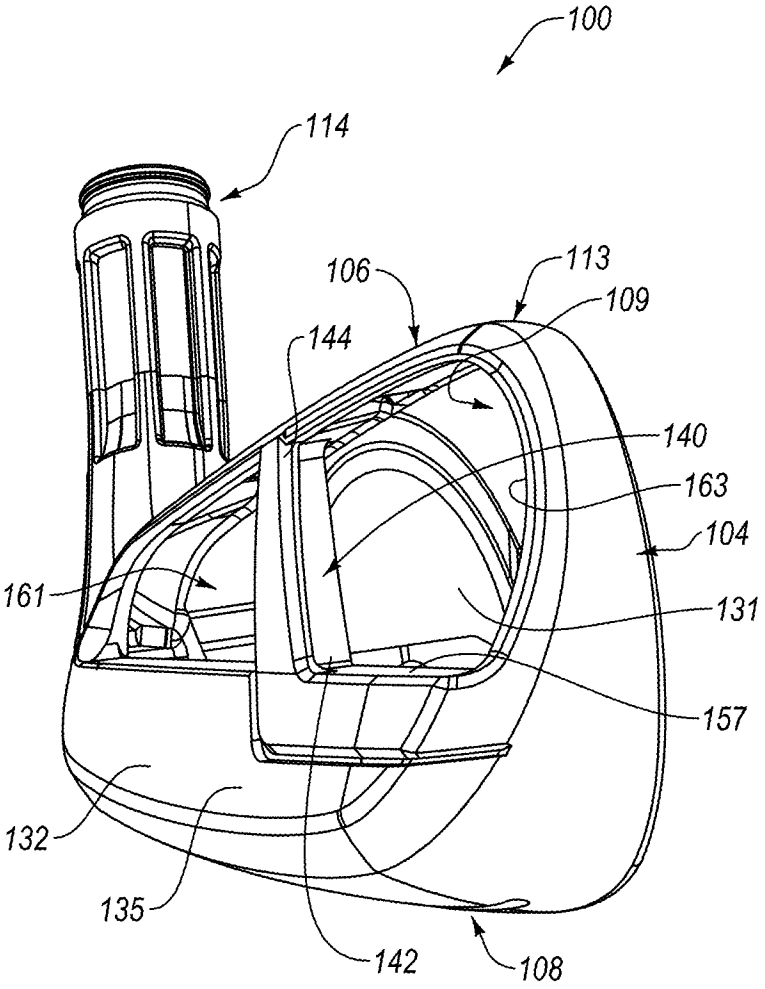
FIG. 7 is a perspective view of the golf club head of FIG. 1, from a rear-toe of the golf club head, according to one or more examples of the present disclosure.
Figure 8:
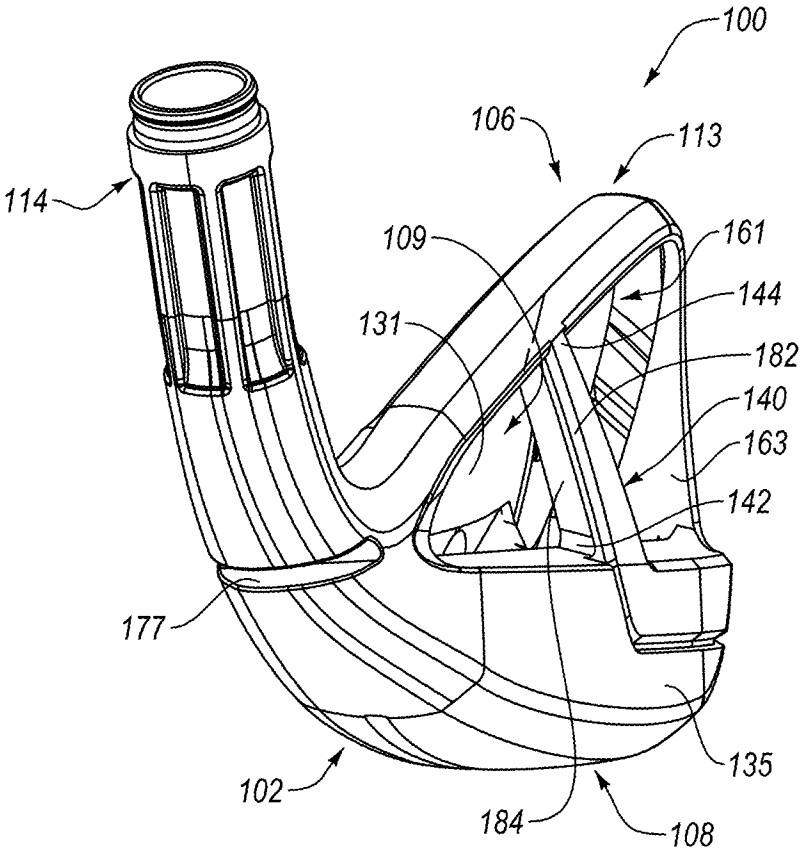
FIG. 8 is a perspective view of the golf club head of FIG. 1, from a rear-heel of the golf club head, according to one or more examples of the present disclosure.

Referring to FIG. 6, an areal mass of the rear portion 128 of the golf club head 100 between the topline portion 106, the sole portion 108, the toe portion 104, and the heel portion 102 is between 0.0005 g/mm$^2$ and 0.00925 g/mm$^2$, such as, for example, about 0.0037 g/mm$^2$. Generally, the areal mass of the rear portion 128 is the mass per unit area of the area defined by the opening 163 to the cavity 161. In some implementations, the area of the opening 163 is about 1,600 mm$^2$.

According to some implementations, the width $W_{BB}$ of the bridge bar 140 is between 2 mm and 25 mm. In certain implementations, the width $W_{BB}$ of the bridge bar 140 at the bottom end 142 is between 4 mm and 25 mm, between 4 mm and 10 mm, between 6 mm and 15 mm, or between 10 mm and 25 mm. In certain implementations, the width $W_{BB}$ of the bridge bar 140 at the top end 144 is between 2 mm and 25 mm, between 2 mm and 10 mm, between 2 mm and 8 mm, between 2 mm and 6 mm, between 4 mm and 15 mm, or between 8 mm and 25 mm. Accordingly, in various implementations, the width $W_{BB}$ of the bridge bar 140 at the bottom end 142 is 2-times, 3-times, 4-times, or more times greater than at the top end 144. In some implementations, the length $L_{BB}$ of the bridge bar 140 is between 15 mm and 40 mm, between 19 mm and 31 mm, between 25 mm and 30 mm, between 28 mm and 35 mm, between 21 mm and 24 mm, or between 20 mm and 26 mm. In one particular implementation, the width $W_{BB}$ of the bridge bar 140 at the bottom end 142 is about 6.5 mm and the width $W_{BB}$ of the bridge bar 140 at the top end 144 is about 2.5 mm.

Referring to FIGS. 10A-10I, the bridge bar 140 also has a depth $D_{BB}$ less than the length Lo of the bridge bar 140. The depth $D_{BB}$ of the bridge bar 140 is the minimum distance from a given point on a rearward side of the bridge bar 140 to a forward side of the bridge bar 140 in a direction substantially parallel with the y-axis 107 (e.g., front-to-rear direction). In certain implementations, the depth $D_{BB}$ of the bridge bar 140 is between 3.0 mm and 10 mm, between 4 mm and 8 mm, or between 4.5 mm and 7 mm. The depth $D_{BB}$ of the bridge bar 140 can be greater at the bottom end 142 than at the top end 144. For example, the depth $D_{BB}$ of the bridge bar 140 at the bottom end 142 is at least 1.5-times, 2.0-times, 2.5-times, or more times greater than at the top end 144. In one implementation, the depth $D_{BB}$ of the bridge bar 140 at the bottom end 142 is 6.9 mm and the depth $D_{BB}$ of the bridge bar 140 at the top end 144 is 4.5 mm.

Additionally, in some implementations, the bridge bar includes one or more webs 143 or flanges 141 (e.g., arms). For example, referring to FIG. 10A, the bridge bar 140 includes a flange 141 and a web 143, perpendicular to the flange 141, to form a T-shape and the bridge bar 140 in FIG. 10E includes two flanges 141 and one web 143, perpendicular to the flanges 141, to form an I-shape. Each flange 141 and each web 143 of the bridge bar 140 has a corresponding thickness T less than the width $W_{BB}$ and depth $D_{BB}$ of the bridge bar 140. In some implementations, the thickness T is between 0.5 mm and 5.0 mm, between 0.7 mm and 3.0 mm, between 1.0 mm and 2.0 mm, or between 1.2 mm and 1.75 mm. In one implementation, the thickness T is about 1.5 mm.

In some implementations, such as those shown, the bridge bar 140 is angled relative to the vertical direction (e.g., the z-up axis 171). For example, as shown in FIG. 6, the bridge bar 140 forms an angle θ relative to the vertical direction. The angle θ is between zero and 180-degrees, exclusively. In some implementations, the angle θ is between about 30-degrees and about 60-degrees. As shown, the bridge bar 140 may be oriented such that, going from the bottom end 142 of the bridge bar 140 to the top end 144 of the bridge bar 140, the bridge bar 140 is angled or extends toward the heel portion 102 of the golf club head 100. However, in other embodiments, the bridge bar 140 may be oriented such that, going from the bottom end 142 of the bridge bar 140 to the top end 144 of the bridge bar 140, the bridge bar 140 is angled or extends toward the toe portion 104 of the golf club head 100.

Figures 10A, 10B, 10C, 10D, 10E, 10F, 10G, 10H, 10I:
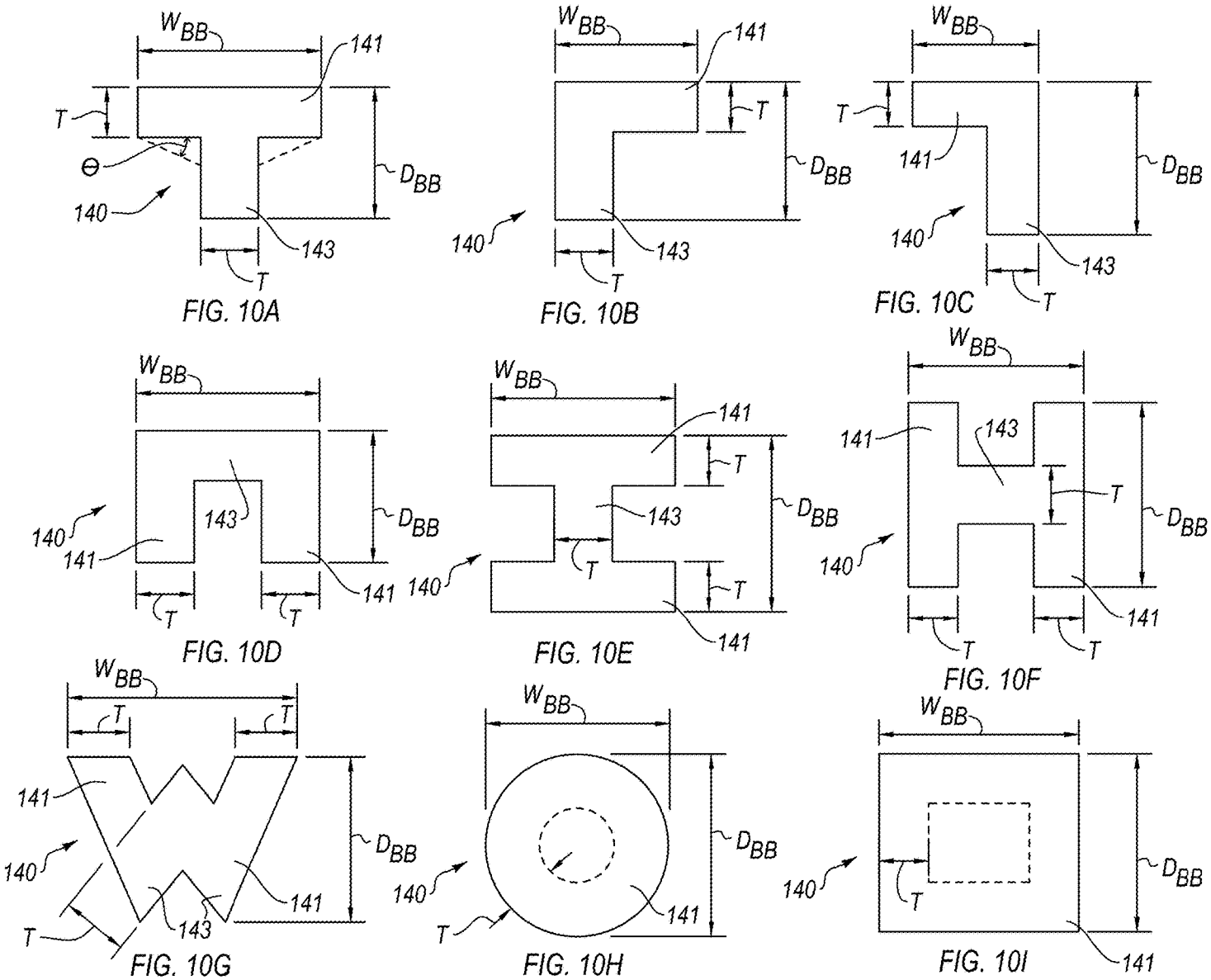
FIGS. 10A-10I are cross-sectional views of a bridge bar of a golf club head, taken along a line analogous to the line 10-10 of FIG. 6, according to one or more examples of the present disclosure.

The bridge bar 140 can have a cross-section, taken along the line 10-10 of FIG. 6, which is parallel to the x-y plane, that has any of various shapes. Referring to FIG. 10A, in one embodiment, the bridge bar 140 has a substantially T-shaped cross-section. More specifically, the bridge bar 140 includes a flange 141, substantially parallel with the X-axis 105, and a web 143, substantially parallel with the Y-axis 107. The flange 141 is co-formed with the web 143. The flange 141 can be substantially flush with a rear surface of the sole bar 135 and the web 143 can extend across the top surface 157 of the sole bar 135 from the flange 141 towards the strike plate 109. However, in other implementations, the bridge bar 140 can be oriented differently, such as, for example, rotated 180-degrees relative to that shown in FIGS. 7, 8, and 10A so that the flange 141 is forward of the web 143.

The bridge bar 140 can have a cross-sectional shape different than a T-shape (e.g., FIG. 10A), such as an L-shape (e.g., FIGS. 10B and 10C), U-shape (e.g., FIG. 10D), I-shaped (e.g., FIG. 10E), H-shape (e.g., FIG. 10F), W-shape (e.g., FIG. 10G), circular-shape (e.g., FIG. 10H), square-shape or rectangular-shape (e.g., FIG. 10I), and the like. Also, the cross-sectional shape and/or size of the bridge bar 140 may change over the length of the bridge bar 140. For example, in the illustrated embodiments, while the cross-sectional shape of the bridge bar 140 is constant over the length of the bridge bar 140, the cross-sectional size of the bridge bar 140 decreases from the sole bar 135 toward the topline portion 106. The bridge bar 140 can be constructed to be solid or hollow. For example, the circular and square shaped bridge bars 140 of FIGS. 10H and 10I can be solid or optionally have a hollow interior channel as shown in dashed line. As shown in dashed lines, the T-shape of the bridge bar 140 of FIG. 10A can be modified such that a thickness of the flange 141 decreases away from the web 143. In other words, the flange 141 can be thicker nearer the web 143 than further away from the web 143. The angle of divergence $\theta_D$ of the flange 141 can be greater at the bottom end 142 (e.g., 15-degrees) than at the top end 144 (e.g., 5-degrees).

Notwithstanding the above, the bridge bar 140 may have any construction to provide any desired rigidity, but it is preferred that the bridge bar 140 is constructed to rigidly couple together the topline portion 106 and the sole bar 135 and so that their weight is minimized. Preferably, the weight of the bridge bar 140 is less than about 12 grams and more preferably less than about 8 grams. In some implementations, the bridge bar 140 is sized, shaped, and made from a material such that the bridge bar 140 has a mass per unit length of between about 0.09 g/mm and about 0.40 g/mm, such as between about 0.09 g/mm and about 0.35 g/mm, such as between about 0.09 g/mm and about 0.30 g/mm, such as between about 0.09 g/mm and about 0.25 g/mm, such as between about 0.09 g/mm and about 0.20 g/mm, such as between about 0.09 g/mm and about 0.17 g/mm, or such as between about 0.1 g/mm and about 0.2 g/mm. In some embodiments, the bridge bar 140 has a mass per unit length less than about 0.25 g/mm, such as less than about 0.20 g/mm, such as less than about 0.17 g/mm, such as less than about 0.15 g/mm, such as less than about 0.10 g/mm. In one implementation, the bridge bar 140 has a mass per unit length of 0.16 g/mm.

According to one embodiment, the top end 144 of the bridge bar 140 is fixed directly to one of the ribs 192 of the top wall 169 of the topline portion 106. The thicker rib 192 provides a more rigid and stronger platform to which the bridge bar 140 can be fixed compared to the thinner pockets 190.

The bottom end 142 of the bridge bar 140 can be fixed to the sole bar 135 at any of various locations relative to the X-axis 105 and the top end 144 of the bridge bar 140 can be fixed to the topline portion 106 at any of various locations relative to the X-axis 105. In one implementation, a center of the bottom end 142 of the bridge bar 140 has an x-axis coordinate of approximately zero.

Figure 16:
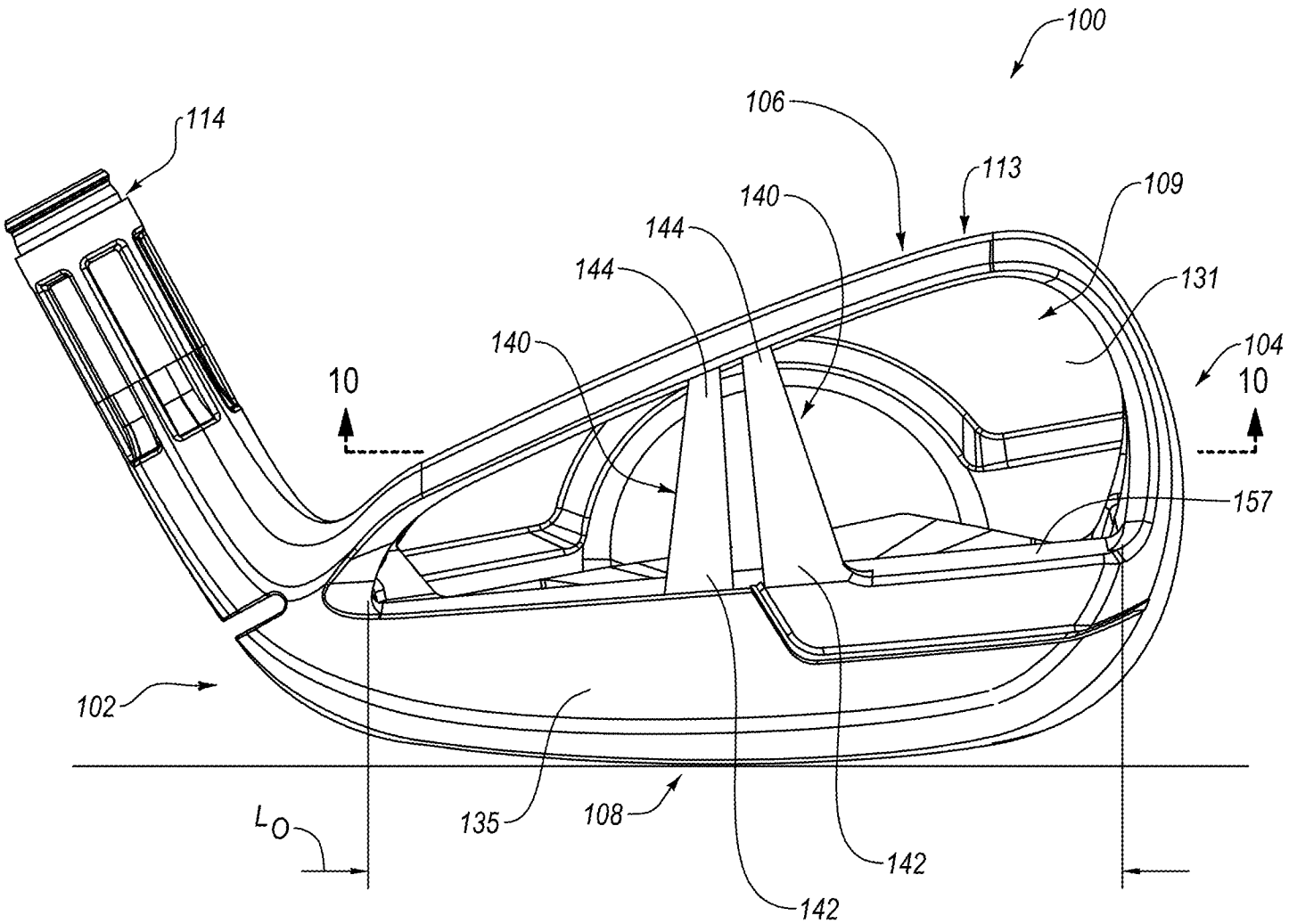
FIG. 16 is a back elevation view of a golf club head, according to one or more examples of the present disclosure.
Figure 17:
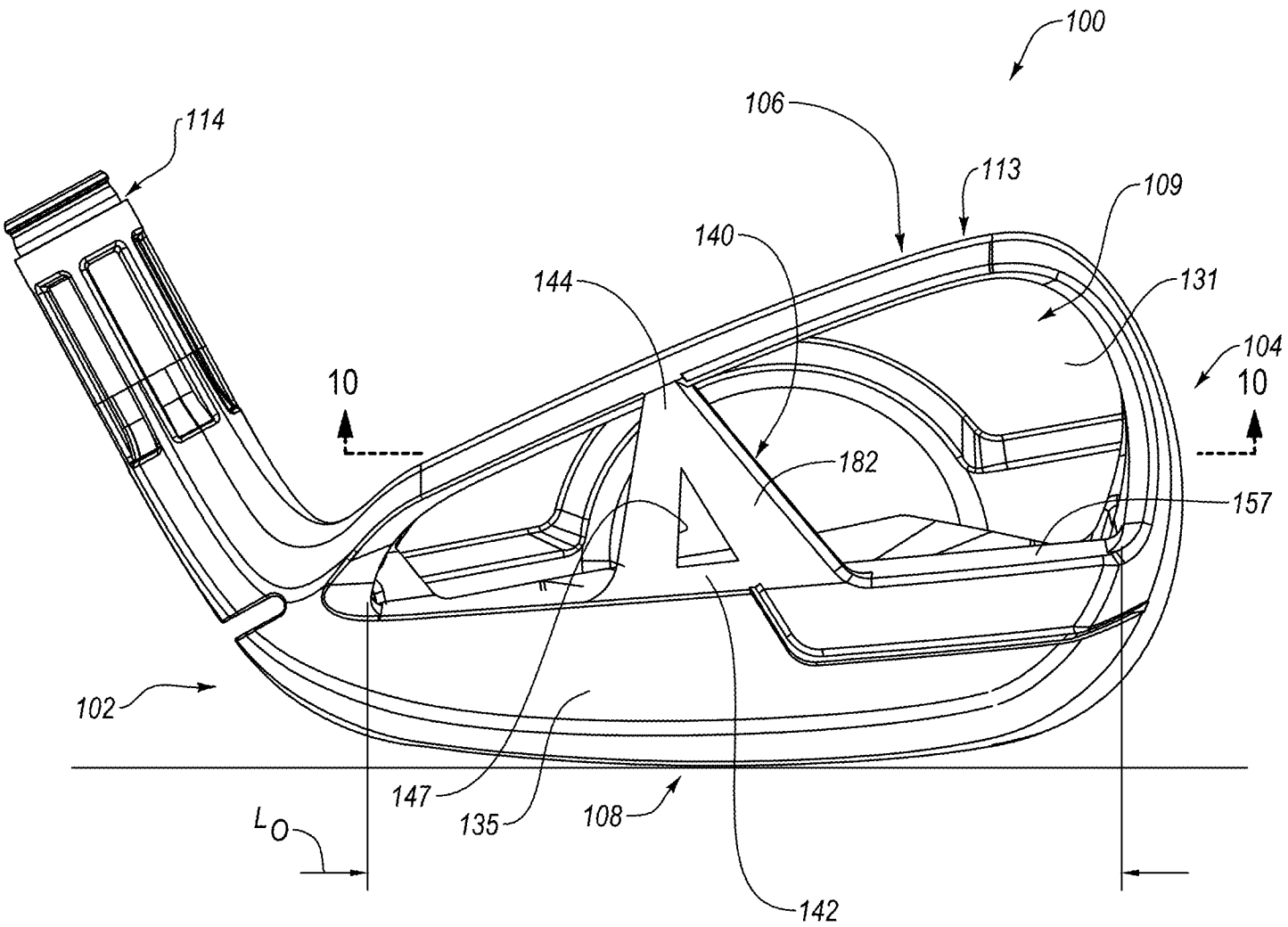
FIG. 17 is a back elevation view of a golf club head, according to one or more examples of the present disclosure.
Figure 18:
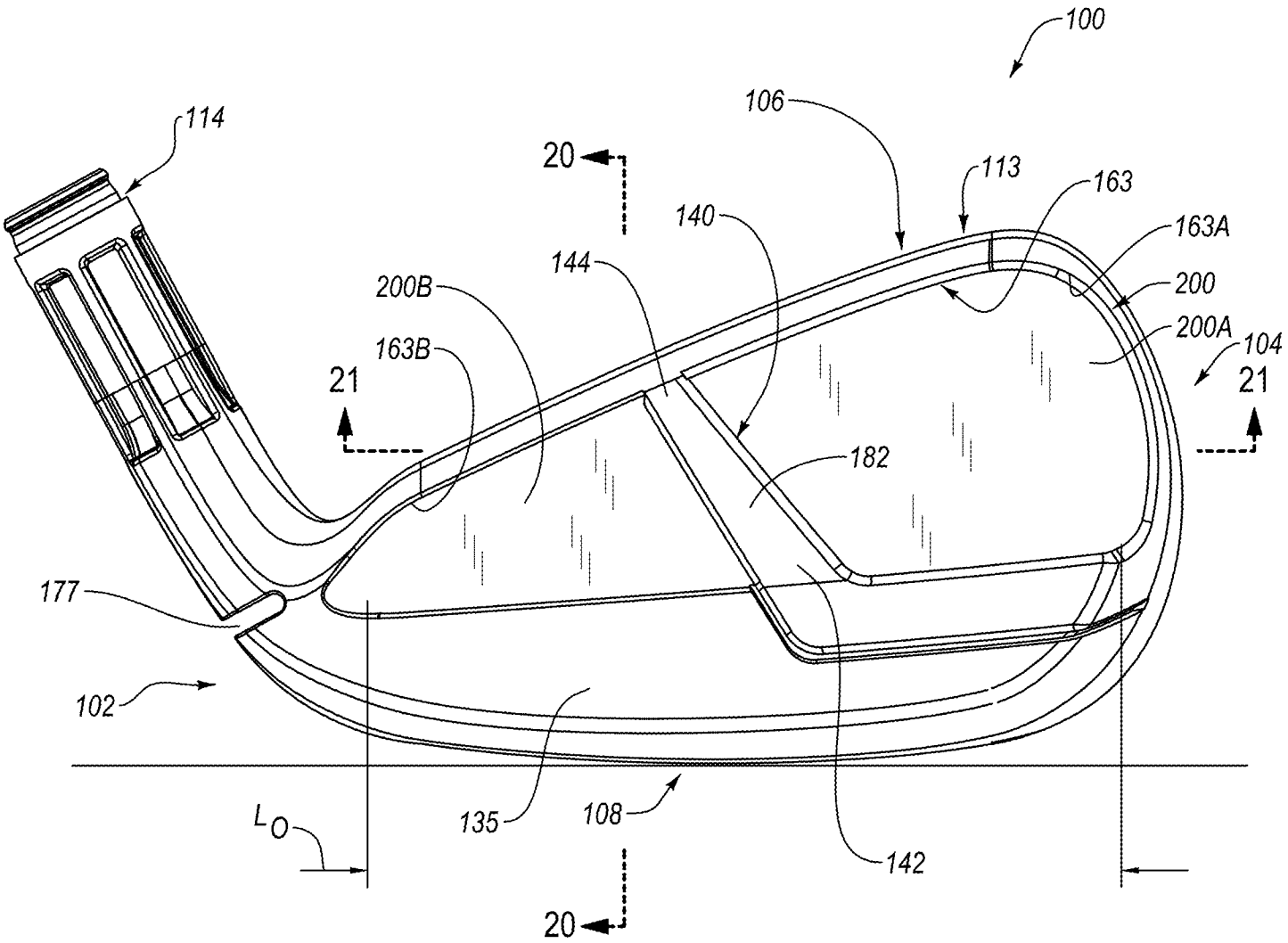
FIG. 18 is a back elevation view of a golf club head, according to one or more examples of the present disclosure.
Figure 19:
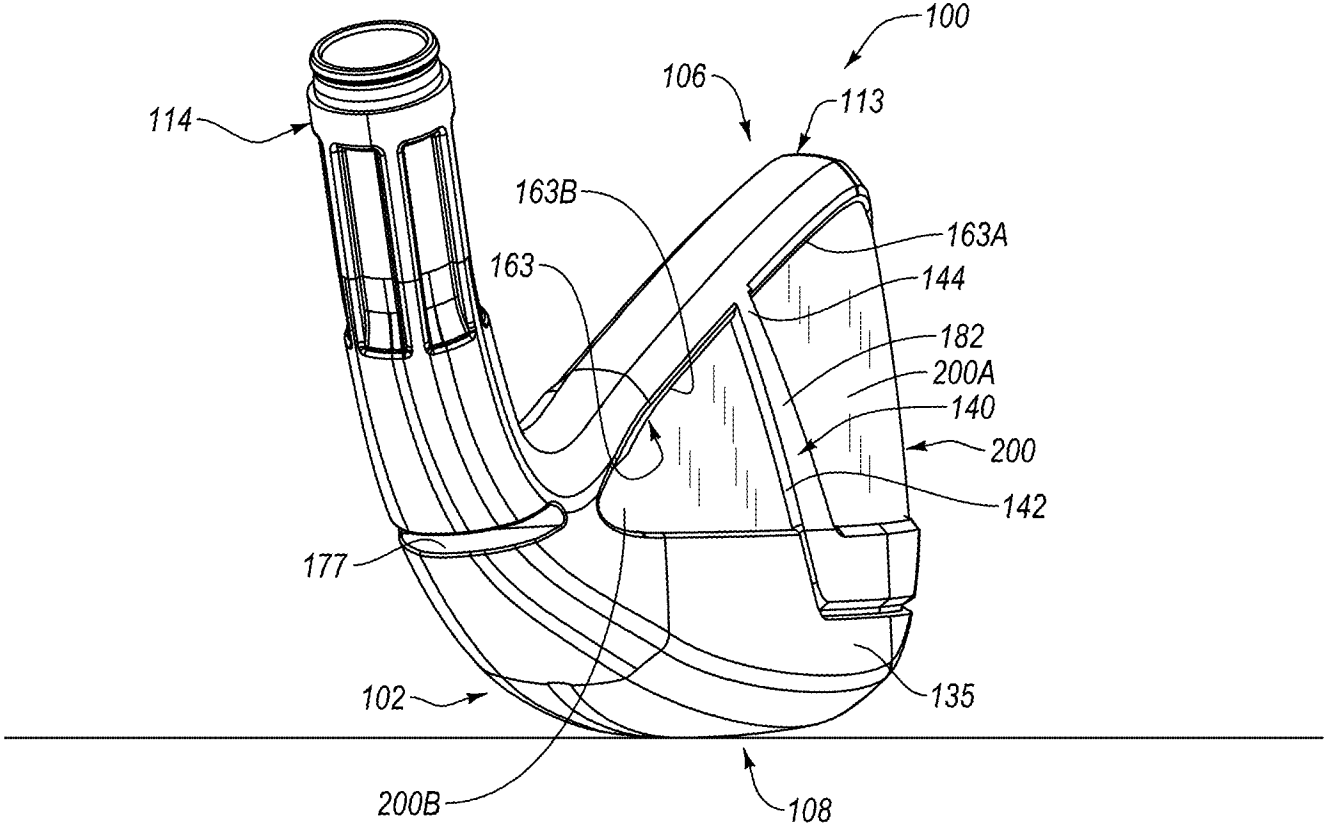
FIG. 19 is a perspective view of the golf club head of FIG. 18, from a rear-heel of the golf club head, according to one or more examples of the present disclosure.

Although the golf club head 100 of FIGS. 6-10 has a single bridge bar 140, in other embodiments, the golf club head 100 can have multiple bridge bars 140, which can be parallel to each other or angle relative to each other. For example, as shown in FIG. 16, the golf club head 100 includes two bridge bars 140 spaced apart from each other along the sole bar 135. Each of the bridge bars 140 has a bottom end 142 and a top end 144 fixed to the sole bar 135 and the topline portion 106, respectively. The bottom ends 142 are spaced apart from each other and the top ends 144 are spaced apart from each other. The bridge bars 140 can have the same size or be sized differently. Additionally, the bridge bars 140 can be angled relative to the vertical direction, where the bridge bars 140 are at the same angle or different angles, or parallel to the vertical direction. Moreover, the multiple bridge bars 140 of the same golf club head 100 can have the same or different cross-sectional shapes. According to another example shown in FIG. 17, instead of multiple, spaced-apart, bridge bars 140, the golf club head 100 includes a single bridge bar 140 and an aperture 147 formed in the bridge bar 140. In the illustrated embodiment, the aperture 147 is triangular-shaped. However, in other embodiments, the aperture 147 can have any of various other shapes.

Referring to FIGS. 18-21, in some embodiments, the golf club head 100 includes a rear panel 200 that is adjacent the bridge bar 140 and covers the opening 163 to effectively enclose the cavity 161. With the rear panel 200 enclosing the cavity 161, the cavity 161 may be filled with a filler material, such as foam, in a manner similar to that described in U.S. patent application Ser. No. 15/706,632, filed Sep. 15, 2017, which is incorporated by reference in its entirety.

The bridge bar 140 bifurcates the opening 163 to the cavity 161 into a toe portion 163A and a heel portion 163B. Moreover, the rear panel 200 includes a toe panel section 200A and a heel panel section 200B. The toe panel section 200A covers the toe portion 163A of the opening 163 and the heel panel section 200B covers the heel portion 163B of the opening. More specifically, the toe panel section 200A is affixed to a rim or edge of the body 113 defining the toe portion 163A of the opening 163 and the heel panel section 200B is affixed to a rim or edge of the body 113 defining the heel portion 163B of the opening 163. The toe panel section 200A and the heel panel section 200B can be affixed to the body 113 using any of various fixation techniques, such as adhesion, bonding, welding, fastening, and the like. In some implementations, the toe panel section 200A and the heel panel section 200B are affixed such that exterior surfaces of the toe panel section 200A and the heel panel section 200B are substantially flush with the exterior surface of the bridge bar 140, which spans the gap between and separates the toe panel section 200A and the heel panel section 200B. Although not shown, in some implementations, the rear panel 200 may be sized to partially or entirely cover the bridge bar 140.

According to some implementations, the rear panel 200 is a thin-walled structure made of a material different than the material of the bridge bar 140. For example, the rear panel 200 can be made of a material lighter and/or less rigid than the bridge bar 140. In one implementation, the rear panel 200 is made of a composite material, such as a fiber-reinforced polymer material. According to another implementation, the rear panel 200 is made of a plastic material. In some examples, the bridge bar 140 is made of a metal and the rear panel 200 is made of a non-metal material (e.g., with a mass per unit length between 1 g/cc and 2 g/cc and a thickness between 0.5 mm and 1.0 mm).

The golf club head 100 has an associated vertical CG measurement or Z-up, modal frequency, and frequency duration. These characteristics can be measured, via testing of an actual golf club head 100, or estimated, via a finite element analysis simulation of a virtual golf club head 100. Additionally, to emphasize the proportional benefits one or more bridge bars 140 provides to the golf club head 100, these characteristics can be expressed as a delta or shift equal to the difference between the characteristics on the golf club head 100 with the one or more bridge bars 140 and those on the golf club head 100 without the one or more bridge bars 140. Accordingly, the features of the golf club head 100 can include the values of characteristics themselves and/or the shift in the values of the characteristics compared to the same golf club head 100 without bridge bars 140.

The modal frequency of the golf club head 100 is dependent on the mode frequency of concern. Generally, the golf club head 100 has multiple resonant frequencies, each defined as a frequency at which the response amplitude is at a relative maximum. The lowest resonant frequency is considered a first mode frequency and the next lowest resonant frequencies are consecutively ordered mode frequencies, e.g., second mode frequency, third mode frequency, etc. Accordingly, the fourth mode frequency of the golf club head 100 is the fourth lowest resonant frequency of the golf club head 100. Moreover, the golf club head 100 has a frequency duration (i.e., tau time) at each of the mode frequencies. For example, the first mode frequency has a corresponding first mode frequency duration and the fourth mode frequency has a corresponding fourth mode frequency duration. The resonant frequencies can be tied to maximum displacement peaks for particular portions of the golf club head 100. For example, the first lowest frequency at which a first maximum displacement peak of the topline portion 106 occurs can be considered the first mode frequency of the topline portion 106. Similarly, for example, the fourth lowest frequency at which a fourth maximum displacement peak of the topline portion 106 occurs can be considered the fourth mode frequency of the topline portion 106. Because a maximum displacement peak at different locations (e.g., locations 300 in FIG. 1) along the topline portion 106 may be different, the corresponding frequency at which a maximum displacement peak occurs may be different for the different locations. Moreover, the increase in the mode frequencies for the same locations on the topline portion 106 attributed to the bridge bar 140 can be determined by determining and comparing the mode frequencies at those locations with and without the bridge bar 140. Increases in mode frequencies at one particular location along the topline portion 106 are shown in Table 1. As shown, such increases can be 100 Hz, 200 Hz, 1,000 Hz, etc.

Figure 22:
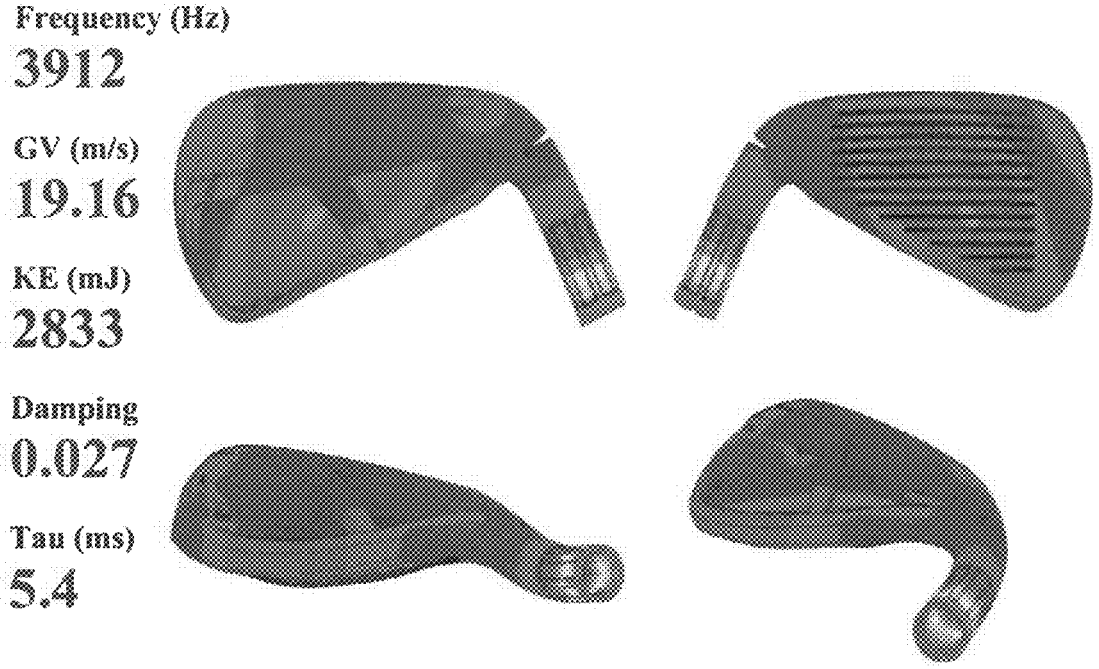
FIG. 22 includes graphical representations of a golf club head, having a bridge bar, undergoing a first mode frequency vibration and associated characteristics of the golf club head, according to one or more examples of the present disclosure.
Figure 24:
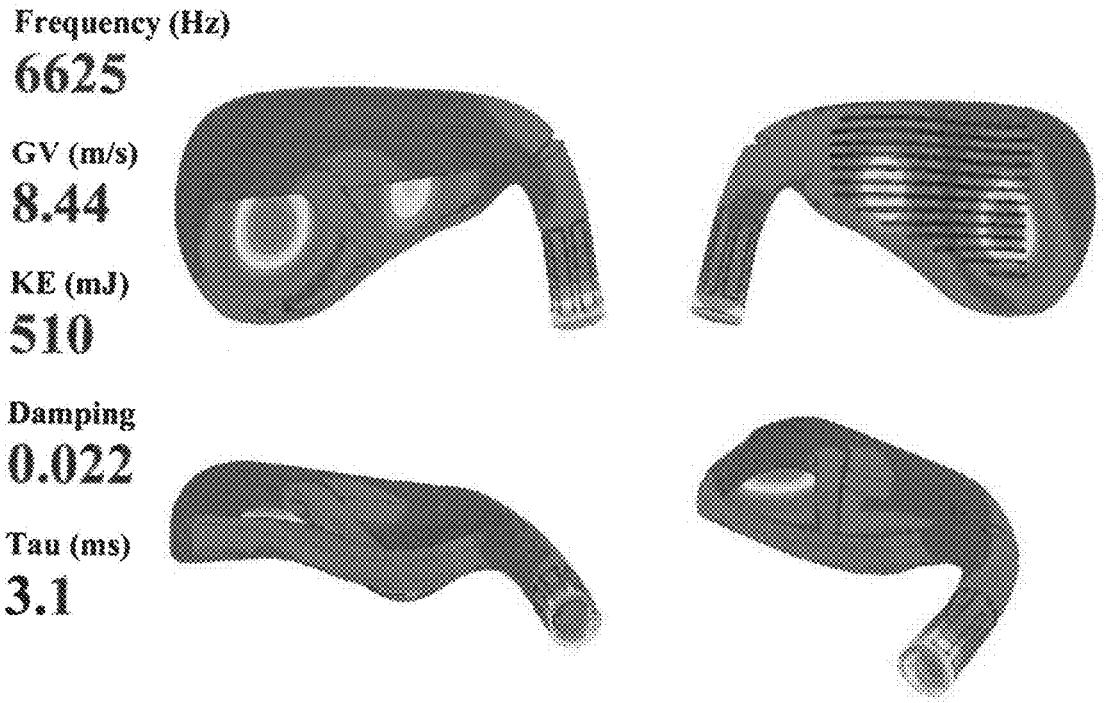
FIG. 24 includes graphical representations of the golf club head of FIG. 22, but without the bridge bar, undergoing a first mode frequency vibration and associated characteristics of the golf club head, according to one or more examples of the present disclosure.

According to one embodiment, the golf club head 100 has a COR between about 0.5 and about 1.0 (e.g., greater than about 0.79, such as greater than about 0.8) and a Z-up less than about 18 mm. In some examples, referring to FIGS. 22 and 24, the golf club head 100 of this embodiment has a first mode frequency of 3,912 Hertz (Hz) and a fourth mode frequency of 6,625 Hz. Also referring to FIGS. 22 and 24, in the same or different examples, the golf club head 100 has a first mode frequency duration of about 5.4 milliseconds (ms) and a fourth mode frequency duration of about 3.1 ms.

Figure 23:
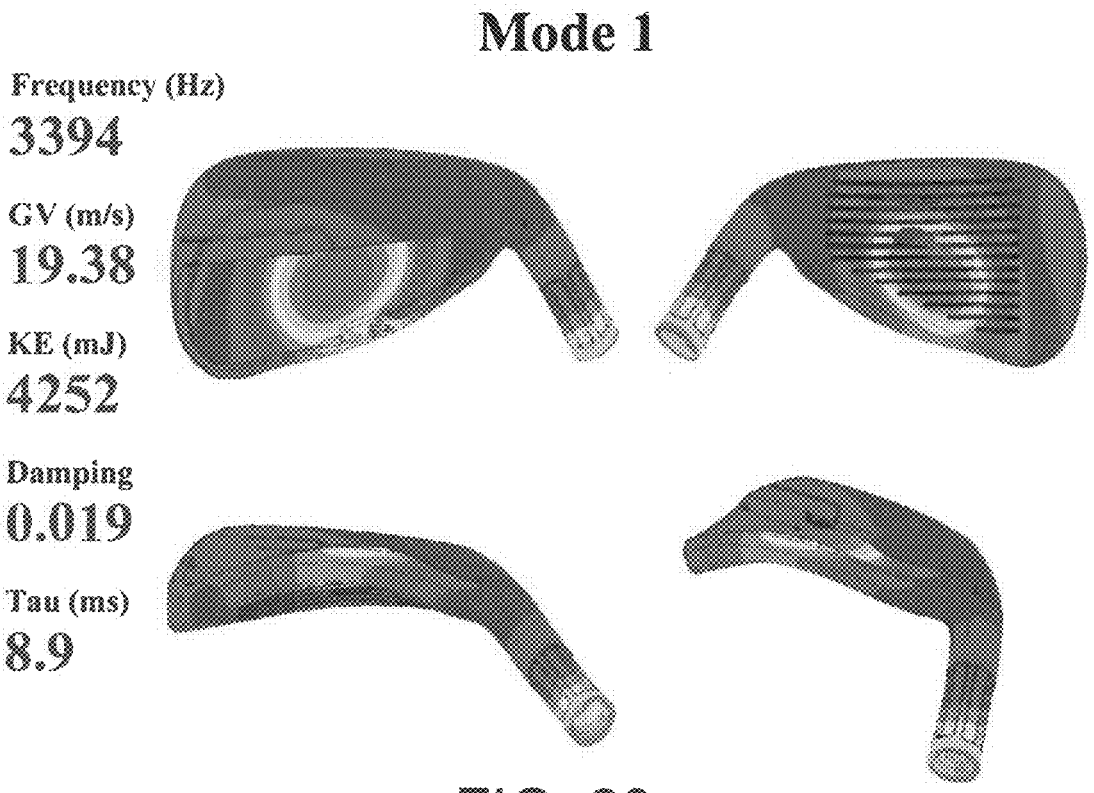
FIG. 23 includes graphical representations of a golf club head, having a bridge bar, undergoing a fourth mode frequency vibration and associated characteristics of the golf club head, according to one or more examples of the present disclosure.
Figure 25:
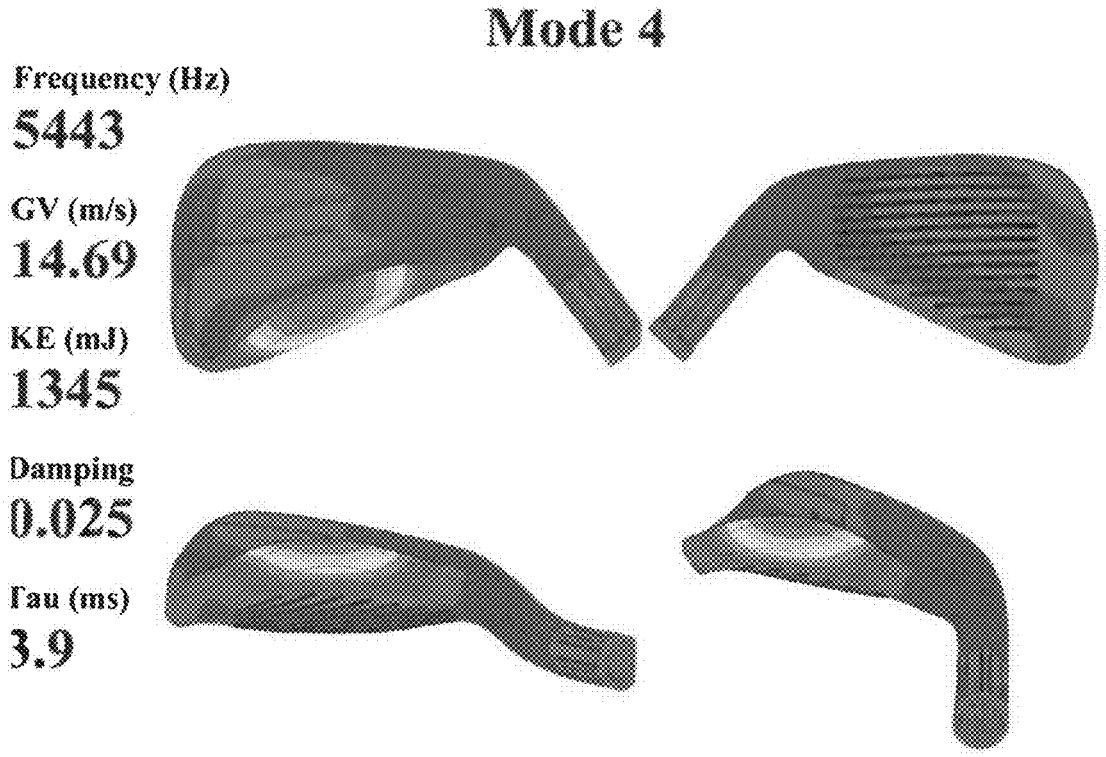
FIG. 25 includes graphical representations of the golf club head of FIG. 23, but without the bridge bar, undergoing a fourth mode frequency vibration and associated characteristics of the golf club head, according to one or more examples of the present disclosure

For comparison, as shown in FIGS. 23 and 25, a club head configured the same as the golf club head 100, but without the bridge bar 140, also has a COR between about 0.5 and about 1.0, but has a Z-up of less than about 16 mm (i.e., Z-up shift of about 2 mm), a first mode frequency of 3,394 Hz (i.e., first mode frequency shift of 518 Hz), a fourth mode frequency of 5,443 Hz (i.e., fourth mode frequency shift of 1,182 Hz), a first mode frequency duration of 8.9 ms (i.e., first mode frequency duration shift of −3.5 ms), and a fourth mode frequency duration of 3.9 ms (i.e., fourth mode frequency shift of −0.8 ms). Accordingly, the bridge bar 140, while increasing the Z-up of the golf club head 100, also promotes an upward shift in the first and fourth mode frequencies and a downward shift in the first and fourth mode frequency durations. According to some implementations, the bridge bar 140 results in a positive or upward Z-up shift of less than 5 mm, less than 4 mm, less than 3 mm, less than 2 mm, or less than 1 mm.

Table 1 below summarizes the modal analysis for the golf club head 100 with the bridge bar 140 and the golf club head 100 without the bridge bar 140. More specifically, Table 2 lists frequency values, at each natural frequency of the golf club head 100 with the bridge bar 140 and the golf club head 100 without the bridge bar, and differences or "delta" between the frequency values at each natural frequency.

TABLE 1

| Natural Frequency | Non-bridge Bar Frequency (Hz) | Bridge Bar Frequency (Hz) | Delta Freq. Frequency (Hz) |
|---|---|---|---|
| First | 3546 | 3925 | 379 |
| Second | 3911 | 4252 | 341 |

TABLE 1-continued

| Natural Frequency | Non-bridge Bar Frequency (Hz) | Bridge Bar Frequency (Hz) | Delta Freq. Frequency (Hz) |
|---|---|---|---|
| Third | 4879 | 4998 | 119 |
| Fourth | 5489 | 6646 | 1157 |
| Fifth | 6875 | 7301 | 426 |
| Sixth | 7674 | 8550 | 876 |
| Seventh | 8744 | 9084 | 340 |
| Eighth | 9448 | 10707 | 1259 |

Figure 26A:
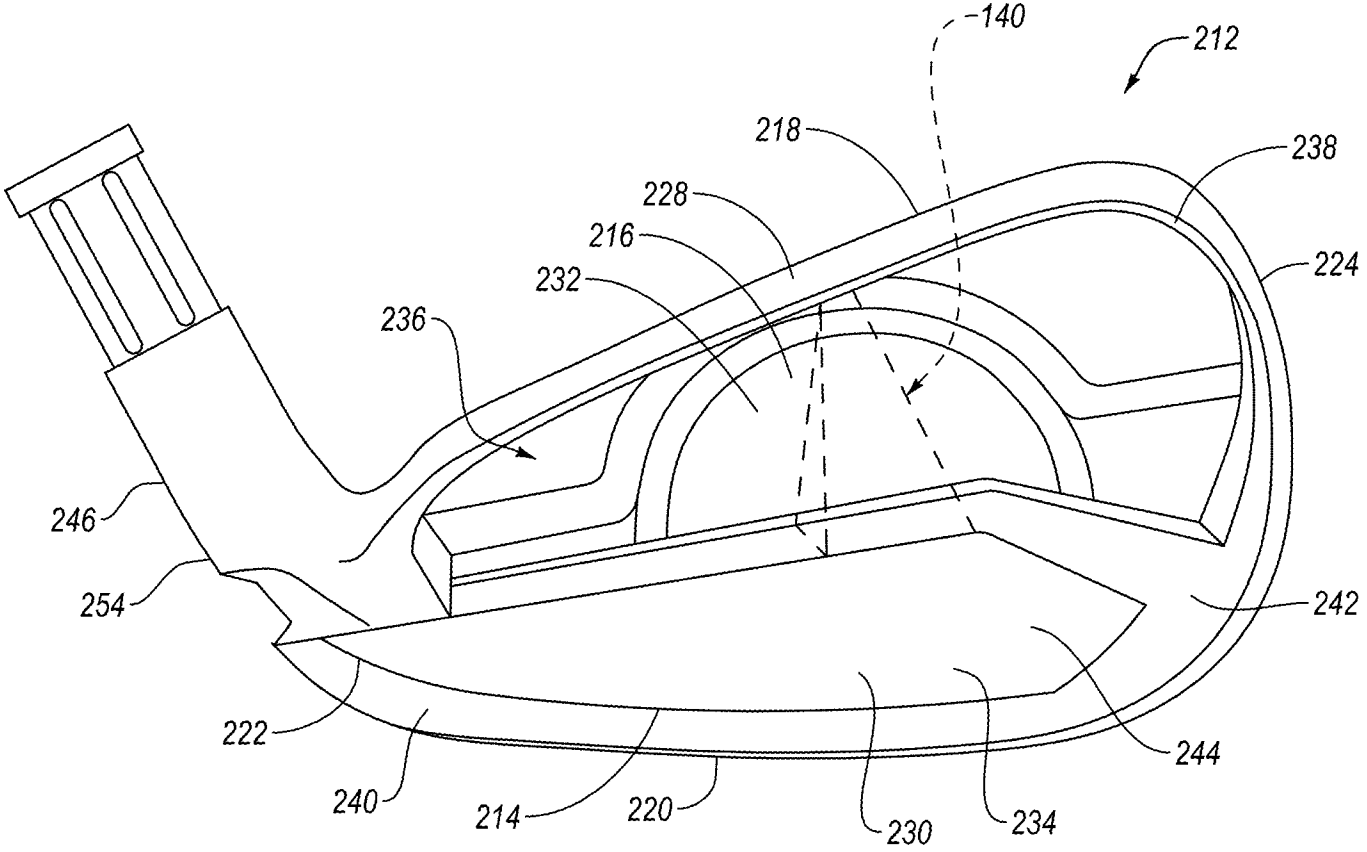
FIG. 26A is a rear elevation view of a golf club head, according to one or more examples of the present disclosure.
Figure 26B:
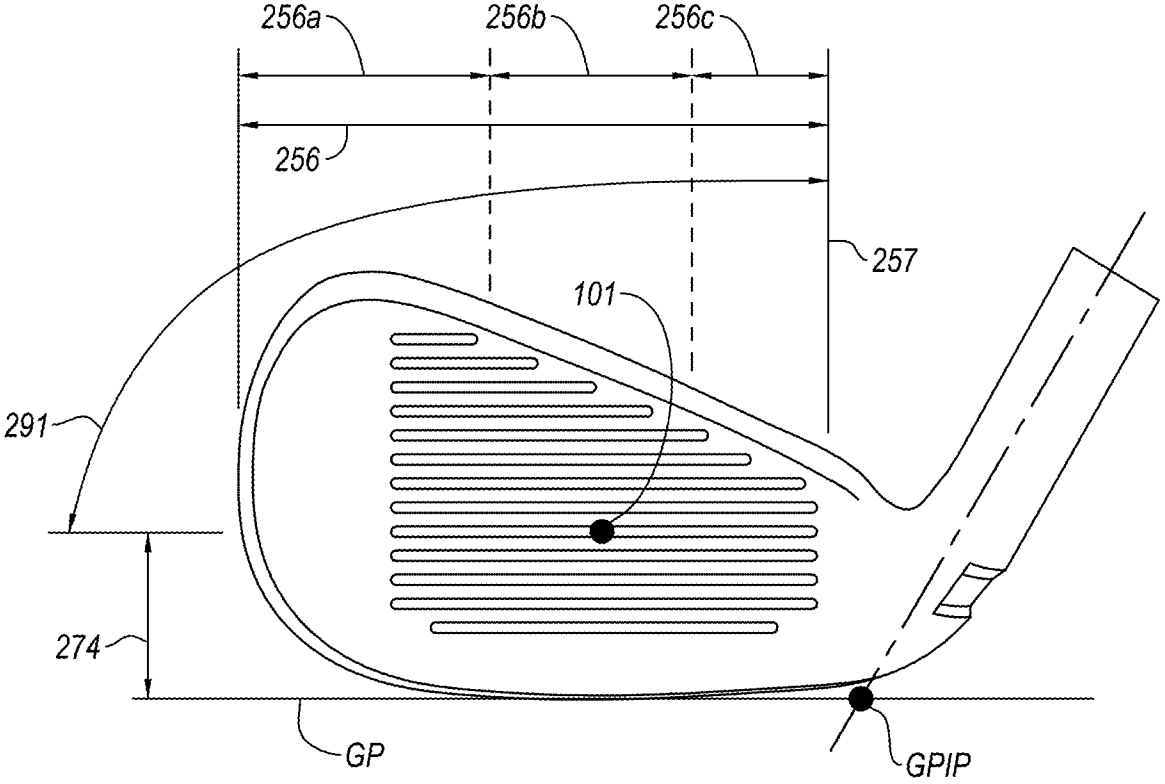
FIG. 26B is a front elevation view of a golf club head, according to one or more examples of the present disclosure.
Figure 27:
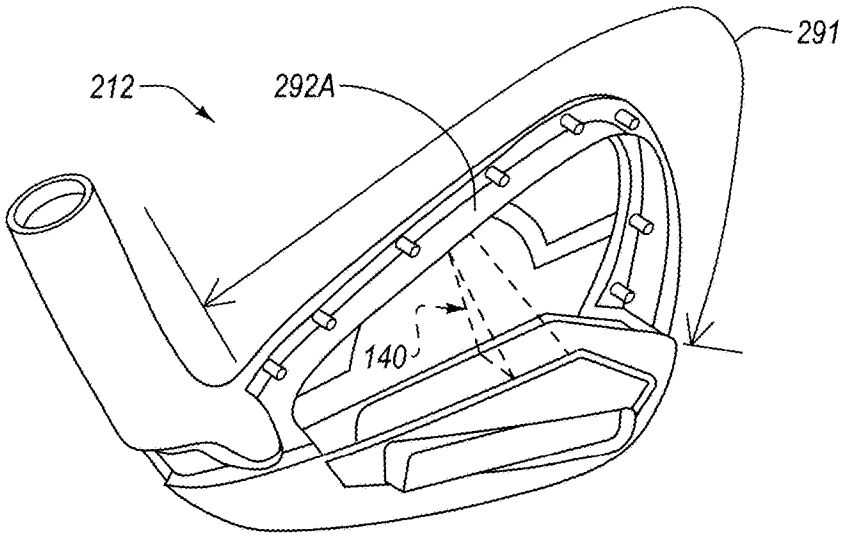
FIG. 27 is a perspective view of a golf club head, from a rear of the golf club head, according to one or more examples of the present disclosure.

Turning attention to FIGS. 26A-35, several designs are shown for achieving a lighter weight topline by employing a weight reducing feature over a topline weight reduction zone 91 (see, e.g., FIGS. 26B and 27). Referring to FIG. 26A, an iron-type golf club head 212 includes a club head body 214 having a strike plate 216, a topline portion 218 defining the upper limit of the strike plate 216, a sole portion 220 defining the lower limit of the strike plate 216, a heel portion 222, a toe portion 224, and a rear portion. The rear portion has a cavity back construction and includes an upper section 228 adjacent the topline portion 218, a lower section 230 adjacent the sole portion 220 and a middle section 232 between the upper section 228 and the lower section 230.

As mentioned above, the iron-type golf club head 212 has the general configuration of a cavity back club head and, consequently, the rear portion 226 includes a flange 234 extending rearwardly around the periphery of the club head body 214. The rearwardly extending flange 234 defines a cavity 236 within the rear portion 226 of the club head body 214. The flange 234 includes a top flange 238 extending rearwardly along the topline portion 218 of the club head body 214 adjacent the upper section 228. The top flange 238 extends the length of the topline portion 218 from the heel portion 222 of the club head body 214 to the toe portion 224 of the club head body 214. The club head body 214 is further provided with rearwardly extending flanges 240, 242 along the heel portion 222 (that is, a heel flange 240) and the toe portion 224 (that is, a toe flange 242) of the club head body 214. These rearwardly extending flanges 238, 240, 242 extend through the upper section 228, lower section 230 and middle section 232 of the rear portion 226 of the iron-type golf club head 212. Additionally, the club head body 214 is provided with a bottom flange 244 extending along the sole portion 220 of the club head body 214.

The iron-type golf club head 212 is preferably cast from suitable metal such as stainless steel. Although shown as a cavity-back iron, the iron-type golf club head 212 could be a "muscle back" or a "hollow" iron-type club and may be any iron-type club head from a one-iron to a wedge.

As shown in FIG. 26B, the topline weight reduction zone 291 extends over the entire face length 256 from the par line 257 to the toe portion 224 ending at approximately the Z-up location 274 of the iron type golf club head 212. However, the topline weight reduction zone 291 may be made into smaller zones, such as, for example, two, three, or four different zones. As shown in FIG. 26B, the face length 256 is broken into three zones, a first zone 256*a*, a second zone 256*b*, and a third zone 256*c*. The zones may be equal in length or of different lengths. The first zone 256*a* will have the most drastic impact on shifting Z-up because it is furthest from the CG, but it will not have a substantial impact on shifting the CG-x towards the toe. The third zone 256*c* will have the least impact on shifting Z-up, but mass removed from the third zone 256*c* may be used to shift CG-x towards the toe. The middle zone 256*b* may be used to shift both Z-up and CG-x, but will have a lesser impact on Z-up than first zone 256*a* and a lesser impact on CG-x than third zone 256*c* because the mass located in this zone is already near the Z-up location and the CG-x location.

Each of weight reducing designs maintains a "traditional" face height for maintaining a traditional profile while offering a savings from about 2 g to about 18 g in the topline weight reduction zone 291, and provides a downward CG-Z shift of at least 0.4 mm to at least 2.0 mm, of at least 0.1 mm to at least 3.0 mm, or of at least 0.2 mm to at least 4.0 mm. This large downward CG-Z shift is the result of mass being removed from locations away from the club head CG and repositioned to a position at or below the club head CG, such as, for example, the sole of the club. Furthermore, the additional structural material removed from the hosel can be relocated to another location on the club, such as the toe portion of the club, to provide a lower center of gravity, increased moments of inertia, or other properties that result in enhanced ball striking performance for the club head.

The weight reducing designs generally have a topline thickness ranging from about 3 mm to about 12 mm. Several of the designs selectively thin portions of the topline resulting in a thinner topline. As a result, a topline wall thickness ranges from of about 1.0 mm to about 8 mm. The topline weight reduction zone 291 extends from about 10 mm to about 80 mm. However, the topline weight reduction zone 291 may extend further or less depending on the face length and desire to adjust the weight savings. For example, a club with a longer face length may have a larger weight reduction zone.

In one example, as shown in FIG. 26A, the weight reducing design of the golf club head is simply a reduced thickness the topline portion 218. For example, the thickness of the topline portion 218 is between about 3 mm and about 5 mm.

In another example shown in FIG. 27, the weight reducing design employs a plastic topline 292*a* as a weight reducing feature to reduce the weight across the entire topline weight reduction zone 291. The plastic topline 292*a* is an efficient way of removing mass from the topline. The plastic topline 292*a* design removes at least 10 g, such as at least 15 g, such as at least 17 g, or such as at least 20 g of mass from the topline portion 218. In the design shown, about 18 g was removed from the topline and reallocated to a lower point on the club head resulting in a downward Z-up shift of about 1.8 mm while maintaining the same overall head weight.

The plastic material may be made from any suitable plastic including structural plastics. For the designs shown, the parts were modeled using Nylon-66 having a density of 1.3 g/cc, and a modulus of 3500 megapascals. However, other plastics may be perfectly suitable and may obtain better results. For example, a polyamide resin may be used with or without fiber reinforcement. For example, a polyamide resin may be used that includes at least 35% fiber reinforcement with long-glass fibers having a length of at least 10 millimeters premolding and produce a finished plastic topline having fiber lengths of at least 3 millimeters. Other embodiments may include fiber reinforcement having short-glass fibers with a length of at least 0.5-2.0 millimeters pre-molding. Incorporation of the fiber reinforcement increases the tensile strength of the primary portion, however it may also reduce the primary portion elongation to break therefore a careful balance must be struck to maintain sufficient elongation. Therefore, one embodiment includes 35-55% long fiber reinforcement, while an even further embodiment has 40-50% long fiber reinforcement.

One specific example is a long-glass fiber reinforced polyamide 66 compound with 40% carbon fiber reinforcement, such as the XuanWu 5 W5801 resin having a tensile strength of 245 megapascal and 7% elongation at break. Long fiber reinforced polyamides, and the resulting melt properties, produce a more isotropic material than that of short fiber reinforced polyamides, primarily due to the three dimensional network formed by the long fibers developed during injection molding.

Another advantage of long-fiber material is the almost linear behavior through to fracture resulting in less deformation at higher stresses. In one particular embodiment the plastic topline is formed of a polycaprolactam, a polyhexamethylene adipinamide, or a copolymer of hexamethylene diamine adipic acid and caprolactam. However, other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties.

In another embodiment, the plastic topline 292*a* is injection molded and is formed of a material having a high melt flow rate, namely a melt flow rate (275°/2.16 Kg), per ASTM D1238, of at least 10 g/10 min. A further embodiment is formed of a non-metallic material having a density of less than 1.75 grams per cubic centimeter and a tensile strength of at least 200 megapascal; while another embodiment has a density of less than 1.50 grams per cubic centimeter and a tensile strength of at least 250 megapascal.

Figure 28:
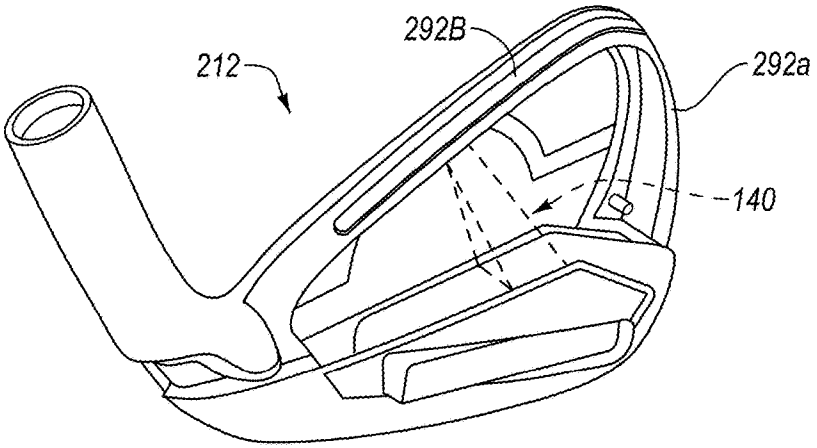
FIG. 28 is a perspective view of a golf club head, from a rear of the golf club head, according to one or more examples of the present disclosure.

The plastic topline 292*b* of FIG. 28 is similar to the plastic topline 292*a* of FIG. 27, except the second plastic topline 229*b* design includes a steel rib inside of the topline for added stiffness. The design shown in FIG. 27 had a mass savings of about 18 g, a Z-up shift of about 1.8 mm, a first mode frequency of 1828 Hz, and tau time (frequency duration) of 7.5 ms. The design shown in FIG. 28 made a slight improvement to sound and tau time with a frequency of 1882 Hz, and a duration of 6.5 ms. However, the mass saving was reduced to about 13 g and, a Z-up shift of about 1.5 min.

Although, the mass savings and Z-up shift is impressive for these two designs, the frequency far below 3,000 Hz may unacceptable for some golfers, and the frequency duration is borderline acceptable. For comparison, the baseline club without any weight reduction done to the topline has a first mode frequency of 3213 Hz and a frequency duration of 4.4 ms. Accordingly the next several designs focus on improving the frequency while still achieving a modest weight savings and Z-up shift. The frequency of these designs would likely be improved if weight reduction was targeted to only zone 256*a*, or zones 256*a* and 256*c*.

Figure 29:
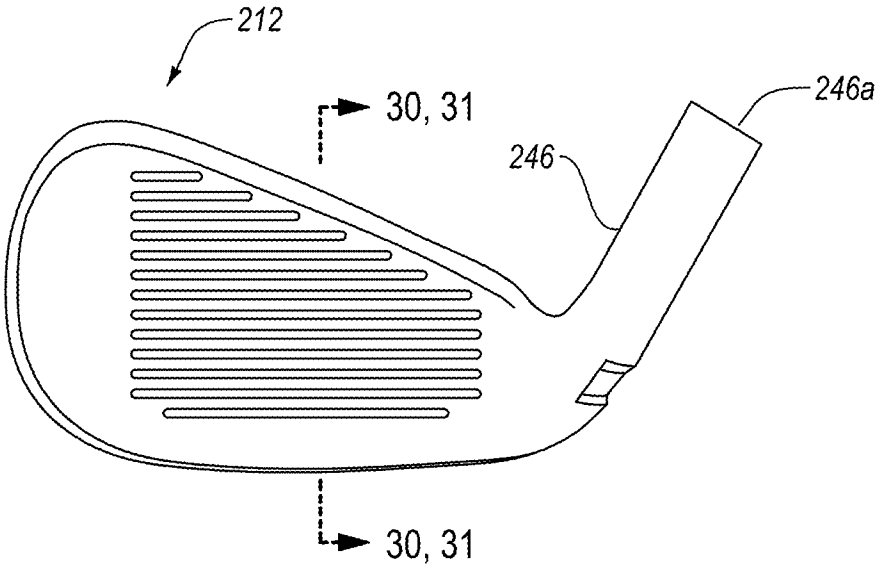
FIG. 29 is a front elevation view of a golf club head, according to one or more examples of the present disclosure.
Figure 31:
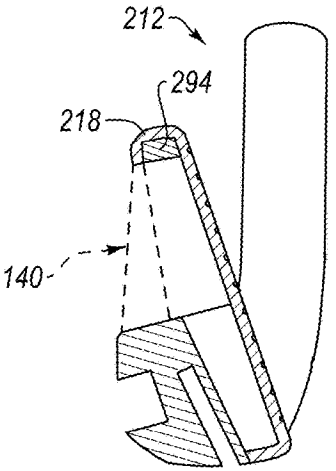
FIG. 31 is a cross-sectional side elevation view of a golf club head, taken along a line analogous to line 31-31 of FIG. 29, according to one or more examples of the present disclosure.
Figure 30:
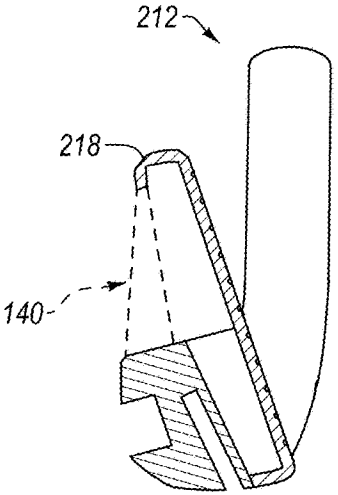
FIG. 30 is a cross-sectional side elevation view of a golf club head, taken along a line analogous to line 30-30 of FIG. 29, according to one or more examples of the present disclosure.

Turning to FIGS. 29-31, alternative designs are shown for removing topline material. These designs selectively remove material from the existing topline to create a rib like structure along the entire topline weight reduction zone 291, while maintaining the traditional look of the topline and keeping the weight reduction substantially visually hidden from the golfer. Thinning the topline in this manner allows for a mass savings of at least 5 g, such as at least 7 g, such as at least 9 g, such as at least 11 g.

In FIGS. 30 and 31, section views are shown so that the thin topline is visible. The design shown in FIG. 30 had a mass savings of about 10 g, a Z-up shift of about 1.3 mm, a first mode frequency of 3092 Hz, and tau time (frequency duration) of 6.6 ms. Generally, the topline portion 218 of FIG. 30 includes a thin-walled overhang that extends rearwardly and downwardly so as to be substantially cup-shaped in cross-section. The design shown in FIG. 31 put back some of the material removed in the form of a plastic topline insert 294 made of Nylon-66. The insert (294) is situated within the cavity (161) between and in contact with only a portion of the back portion (128) and only a portion of the rear surface (131) of the face portion (109) such that the insert (294) does not contact any portion of the one or more rear panels. This was done in an attempt to dampen the frequency and frequency duration. The frequency duration decreased to 5.9 ms, but surprisingly the frequency stayed about the same at 3086 Hz. The mass saving was reduced to about 8 g and, and the Z-up shift decreased to about 1.2 mm. Although, the mass savings and Z-up shift is more modest for these two designs, the frequency is above 3000 Hz, which is acceptable for most golfers, and the frequency duration being below 7 ms is also acceptable.

As already discussed above, instead of reducing weight across the entire topline weight reduction zone 291, a more targeted approach that targets different zones, such as, for example, the first zone 256*a*, the second zone 256*b*, and the third zone 256*c*, may be a better approach to balancing mass reduction and acoustic performance. As already discussed, removing material from the first zone 256*a* allows for a greater impact on Z-up, while removing material from the third zone 256*c* allows for a greater impact to CG-x with only a minor impact to Z-up. Accordingly, if the goal is to shift Z-up, then removing mass from the first zone 256*a* is a more modest approach that would provide better acoustic properties.

Figure 33:
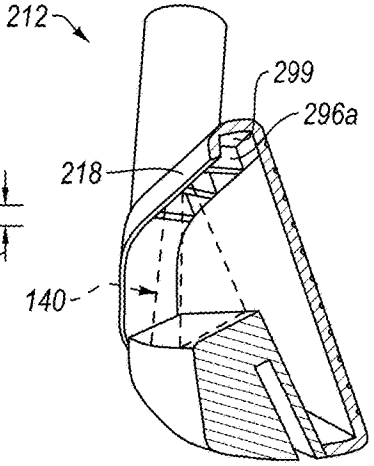
FIG. 33 is a side elevation view of the golf club head of FIG. 32, taken along the line 33-33 of FIG. 32, according to one or more examples of the present disclosure.
Figure 32:
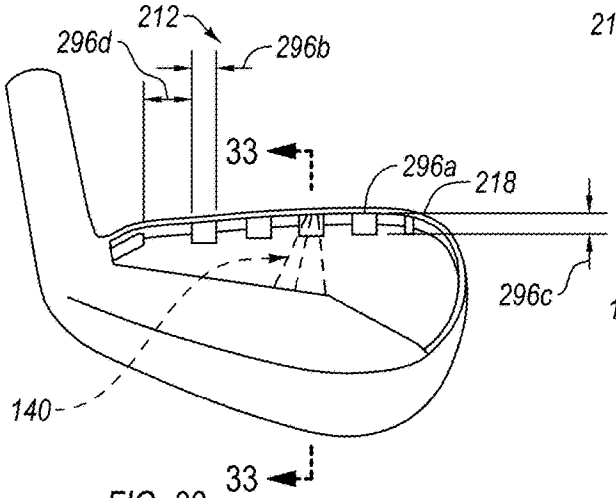
FIG. 32 is a perspective view of a golf club head, from a rear of the golf club head, according to one or more examples of the present disclosure.

Turning to FIGS. 32 and 33, an alternative weight reducing feature is shown for removing topline material. Like the previous design, this design selectively removes material from the topline. However, instead of using a plastic insert to increase stiffness and raise Z-up, steel ribs 296*a* are spaced along the entire topline weight reduction zone 291. The steel ribs 296*a* have a rib width 296*b*, a rib height 296*c*, and a rib spacing 296*d*. The ribs may range in width from about 3 mm to about 10 mm, preferably about 4.5 mm to about 7 mm. The ribs may range in height from about 2 mm to about 10 mm, or preferably about 3 mm to about 7 mm. The rib spacing is measured from the end of one rib to beginning of the next rib and may range from about 3 mm to about 10 mm, preferably about 5 mm to about 8 mm. The ribs 296*a* are coupled to an underside 299 of a rearwardly and downwardly directed overhang of the top portion 218.

The design shown in FIGS. 32 and 33 has a mass savings of about 5 g, a Z-up shift of about 0.9 mm, a first mode frequency of 3122 Hz, and tau time (frequency duration) of 5.7 ms. Although the mass savings and Z-up shift is more modest for this design, the frequency is above 3100 Hz, which is acceptable for most golfers, and the frequency duration being below 6 ms is also acceptable.

Figure 35:
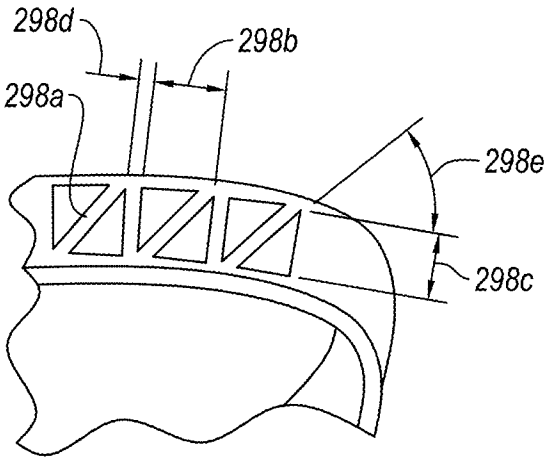
FIG. 35 is a perspective view of a detail of the golf club head of FIG. 33, from a rear of the golf club head, according to one or more examples of the present disclosure.
Figure 34:
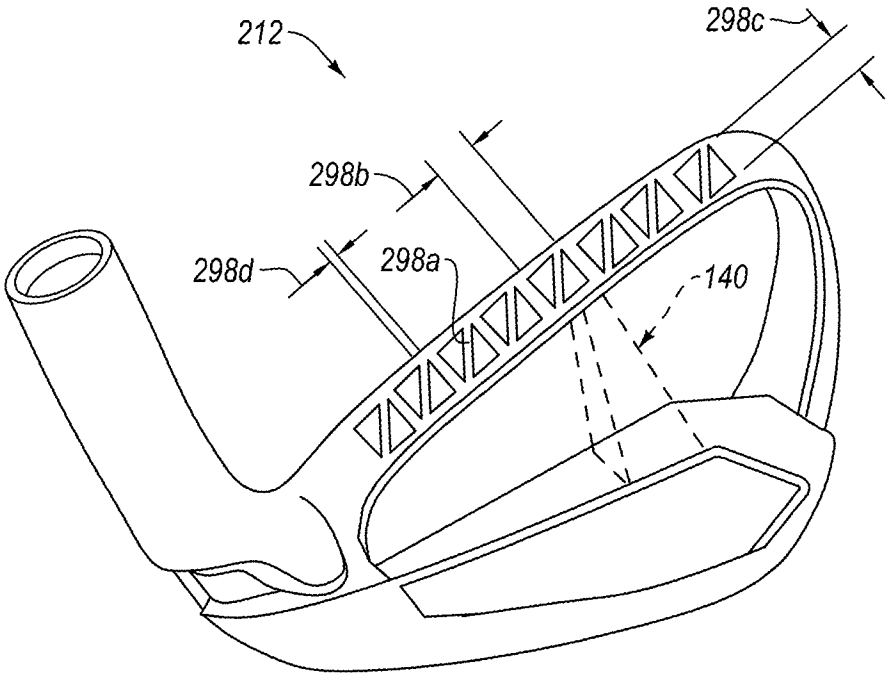
FIG. 34 is a perspective view of a golf club head, from a rear of the golf club head, according to one or more examples of the present disclosure.
Figure 36:
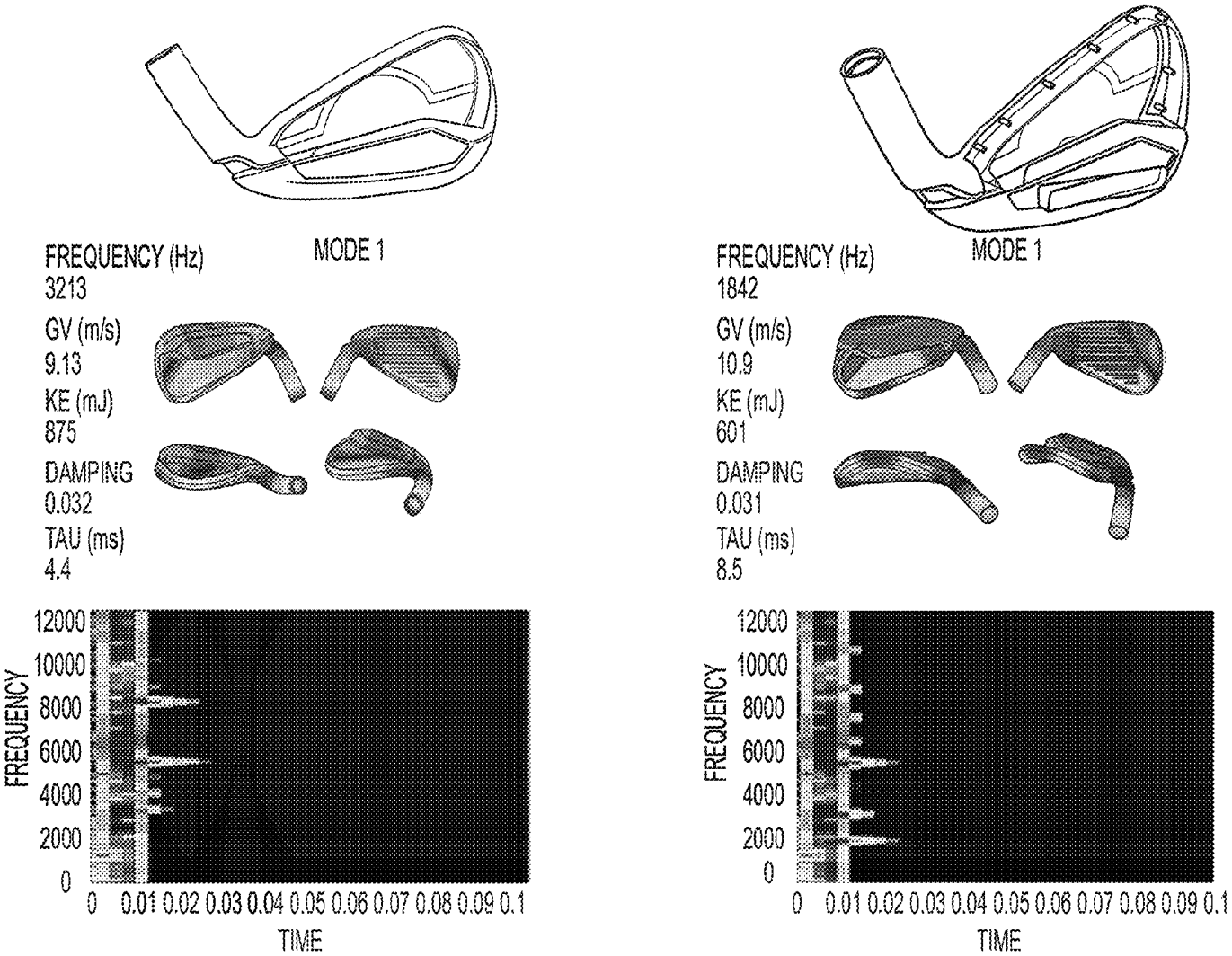
FIG. 36 shows first modal finite element analysis (FEA) results of golf club heads, including the golf club head of FIG. 26 and the golf club head of FIG. 27, according to one or more examples of the present disclosure.
Figure 37:
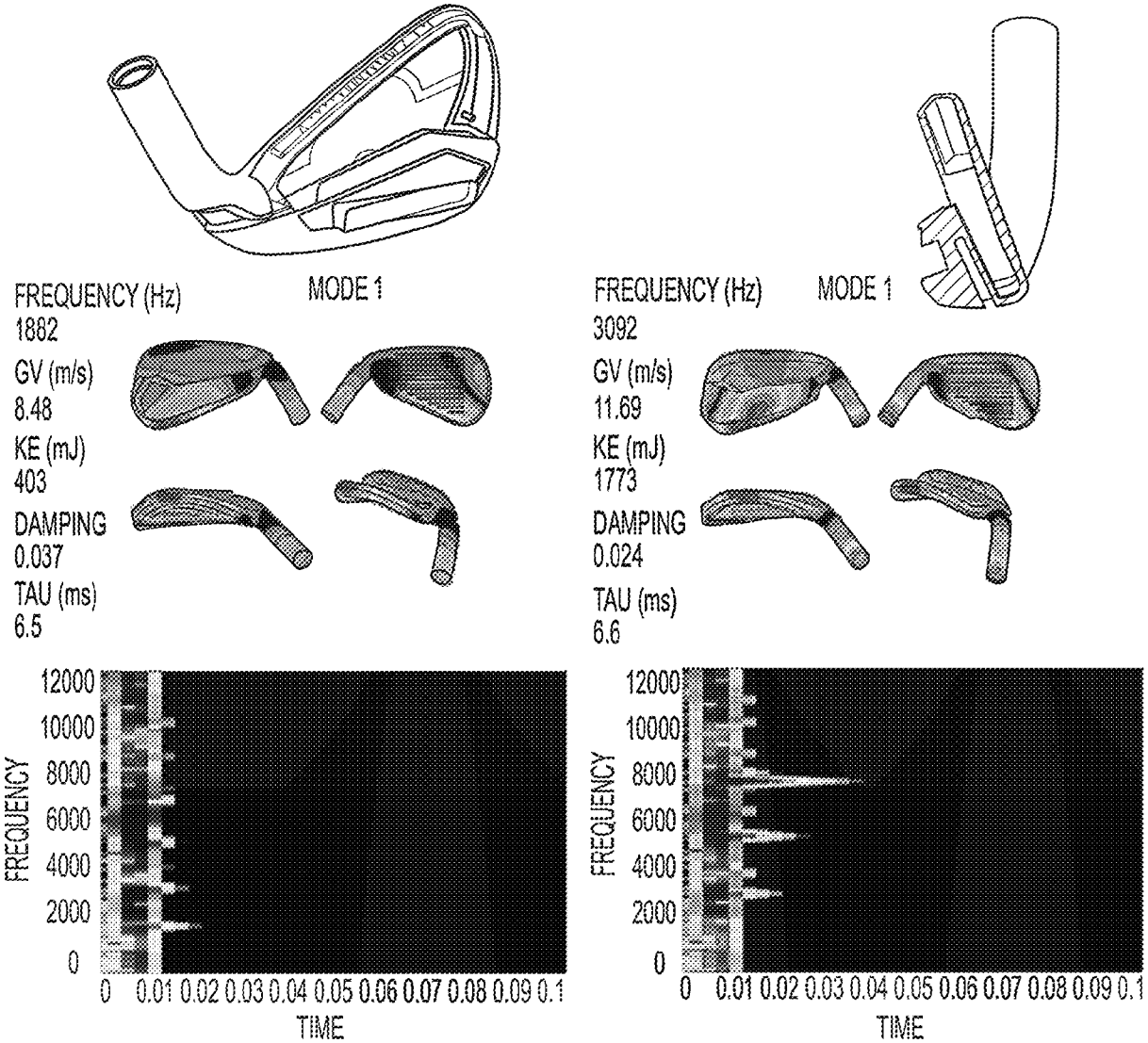
FIG. 37 shows first modal FEA results of golf club heads, including the golf club head of FIG. 28 and the golf club head of FIG. 30, according to one or more examples of the present disclosure.
Figure 38:
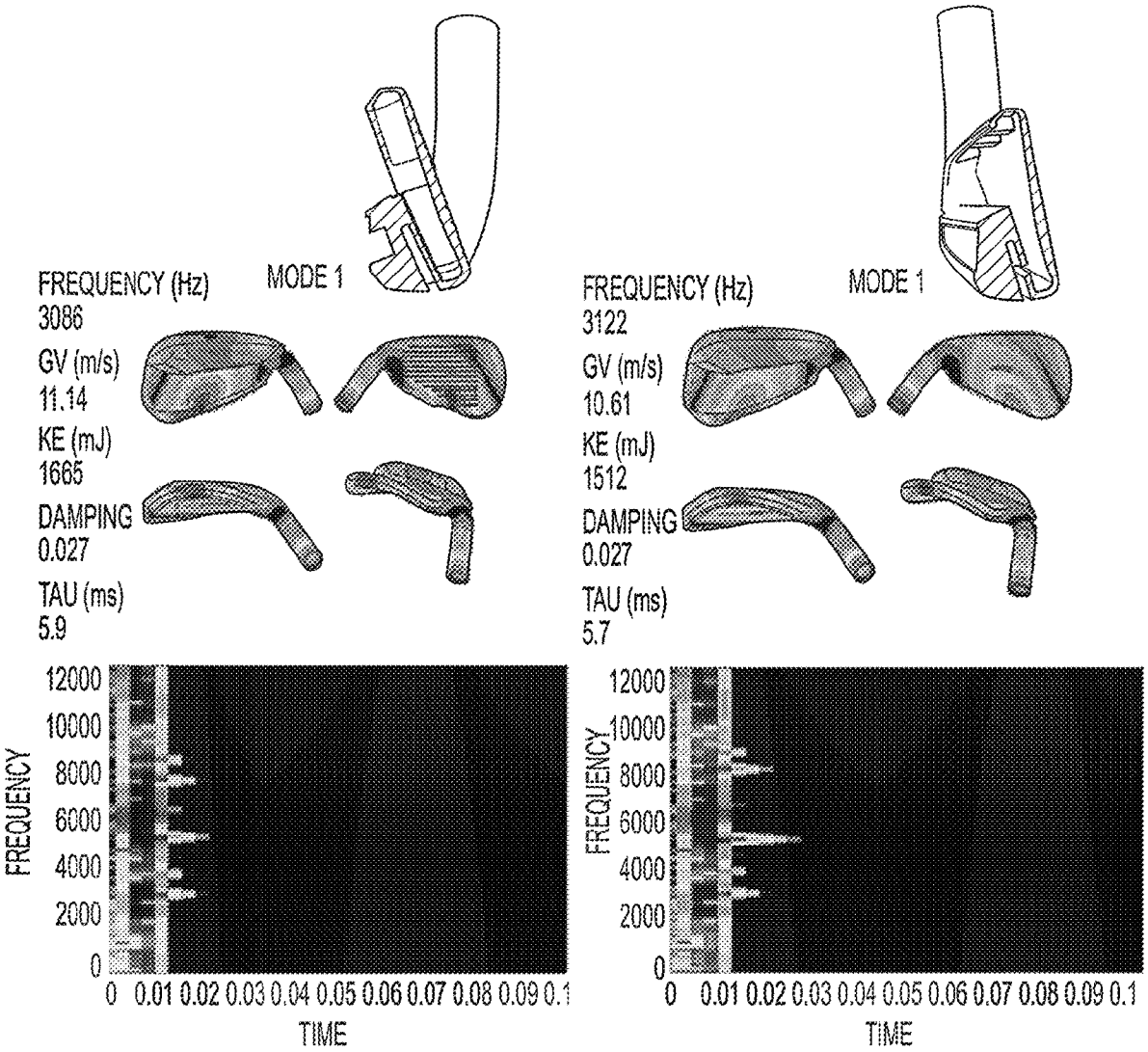
FIG. 38 shows first modal FEA results of golf club heads, including the golf club head of FIG. 31 and the golf club head of FIG. 33, according to one or more examples of the present disclosure.
Figure 39:
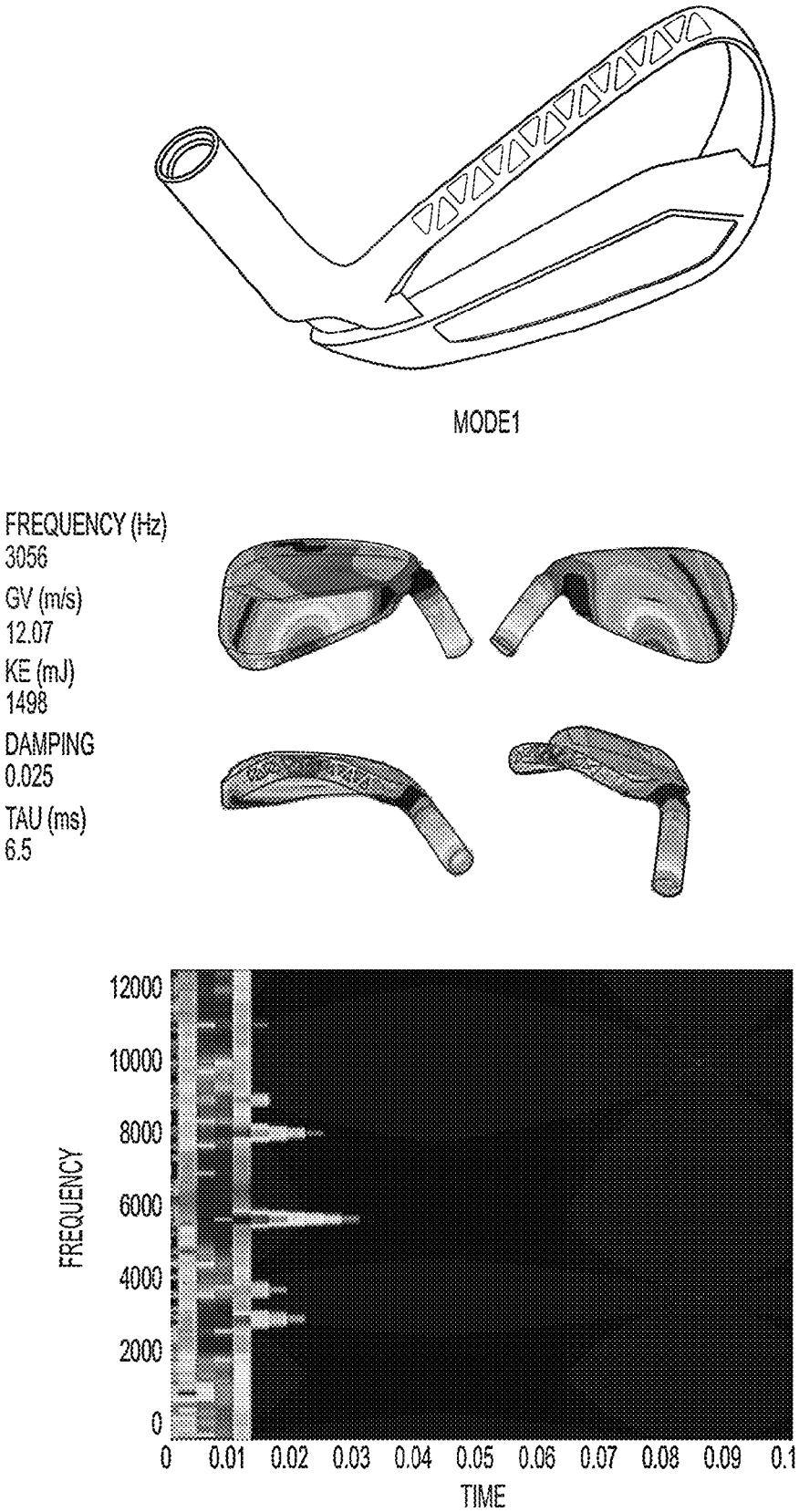
FIG. 39 shows first modal FEA results of the golf club head of FIG. 34, according to one or more examples of the present disclosure.

Referring to FIGS. 34 and 35, an alternative weight reducing feature is shown for removing topline material. Like the previous designs, this design selectively removes material from the topline. However, instead of using ribs to increase stiffness, truss members 298*a* are spaced along the entire topline weight reduction zone 291. As best seen in FIG. 35, the truss members 298*a* have a member width 298*b*, a member height 298*c*, a member spacing 298*d*, and are angled at an angle 298*e* ranging from about 15 degrees to about 75 degrees relative to the topline. The truss members 298*a* may range in width from about 0.75 mm to about 3 mm, preferably about 1.0 mm to about 1.5 mm. The truss members 298*a* may range in height from about 2 mm to about 10 mm, preferably about 3 mm to about 7 mm. The member spacing is measured from the end of one truss member 298*a* to the beginning of the next truss member 298*a* and may range from about 0.75 mm to about 5 mm, preferably about 1 mm to about 3 mm.

The design shown in FIGS. 34 and 35 has a mass savings of about 4 g, a Z-up shift of about 0.9 mm, a first mode frequency of 3056 Hz, and tau time (frequency duration) of 6.5 ms. Although the mass savings and Z-up shift is more modest for this design, the frequency is above 3000 Hz, which is acceptable for most golfers, and the frequency duration being below 7 ms is also acceptable.

FIGS. 36-39 show first modal results for each of the designs discussed above. Table 2 below summarizes the results of the first modal analysis for each of the designs. Table 2 lists several exemplary values for each of the weight reducing designs including mass savings, Z-up, Z-up shift, First Mode Frequency, and First Mode Duration. The measurements reported in Table 2 are without a badge, which may be used to impact the frequency and or duration, such as for example, to dampen the frequency duration.

TABLE 2

| Design (FIGS.) | Mass Savings (g) | Z-up (mm) | Z-up Shift (mm) | First Mode Frequency (Hz) | First Mode Duration (ms) |
|---|---|---|---|---|---|
| 26A, 26B | — | 18.4 | — | 3213 | 4.4 |
| 27 | 18 | 16.6 | 1.8 | 1828 | 7.5 |
| 28 | 13 | 17 | 1.5 | 1882 | 6.5 |
| 30 | 10 | 17.1 | 1.3 | 3092 | 6.6 |
| 31 | 8 | 17.2 | 1.2 | 3086 | 5.9 |
| 32, 33 | 5 | 17.5 | 0.9 | 3122 | 5.7 |
| 34, 35 | 4 | 17.5 | 0.9 | 3056 | 6.5 |

Each iron type golf club head design was modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc.

For each of the above designs, by increasing the depth, width, and/or length of the weight reducing features even more mass savings may be had due to more material being removed. However, it is most beneficial to remove material that is furthest away from the club head CG because this has the most substantial effect on shifting Z-up downward. As discussed above, a lower Z-up promotes a higher launch and allows for increased ball speed depending on impact location.

By using the weight reducing features discussed above, a mass of at least 2 g to at least 20 g may be removed from the hosel and positioned elsewhere on the club to promote better ball speed. By employing the weight reducing features the mass per unit length of the topline can be reduced compared to a club without the weight reducing features. Employing the weight reducing features over a topline length may yield a mass per unit length within the weight reduction zone of between about 0.09 g/mm to about 0.40 g/mm, such as between about 0.09 g/mm to about 0.35 g/mm, such as between about 0.09 g/mm to about 0.30 g/mm, such as between about 0.09 g/mm to about 0.25 g/mm, such as between about 0.09 g/mm to about 0.20 g/mm, or such as between about 0.09 g/mm to about 0.17 g/mm. In some embodiments, the topline weight reduction zone yields a mass per unit length within the weight reduction zone less than about 0.25 g/mm, such as less than about 0.20 g/mm, such as less than about 0.17 g/mm, such as less than about 0.15 g/mm, such as less than about 0.10 g/mm. The mass per unit length values given are for a topline made from a metallic material having a density between about 7,700 kg/m3 and about 8,100 kg/m3, e.g. steel. If a different density material is selected for the topline construction that could either increase or decrease the mass per unit length values. The weight reducing features may be applied over a topline length of at least 10 mm, such as at least 20 mm, such as at least 30 mm, such as at least 40 mm, such as at least 45 mm, such as at least 50 mm, such as at least 55 mm, or such as at least 60 mm.

As discussed above, the iron type golf club head has a certain CG location. The CG location can be measured relative to the x, y, and z-axis. An additional measurement may be taken referred to as Z-up. The Z-up measurement is the vertical distance to the club head CG taken relative to the ground plane when the club head is soled and in the normal address position. It is important to understand that the topline is a large chunk of mass that greatly impacts the CG location of the club head. Accordingly, removing mass from the topline and repositioning the mass at or below the CG, such as, the sole of the club, can significantly impact the CG location of the club head. For example, by employing the weight reducing features, the Z-up shifted downward at least 0.5 mm and in some instances at least 2 mm. This Z-up shift was accomplished while maintaining a traditional profile and traditional heel and toe face heights.

Each of the golf club heads 212 of FIGS. 26A-35 with the topline weight reducing configuration may also include a bridge bar 140 fixed to the topline portion 218 at a top end of the bridge bar 140 and fixed to the flange 234 at a bottom end of the bridge bar 140 in a manner similar to that discussed above with regard to the golf club head 100. The bridge bar 140 can be configured in a manner similar to that described above and provide the same topline stiffness, frequency, and vibration damping advantages as described above. However, the bridge bar 140 may also result in a positive (e.g., upward) Z-up shift, which in some implementations, may negatively affect performance characteristics of the golf club head 212. But with the incorporation of the weight reducing features in the topline portion 218, which results in a negative (e.g., downward) Z-up shift, any negative affect on the Z-up of the golf club head 212 caused by the incorporation of the bridge bar 140 is reduced or offset by the positive effect on Z-up provided by the weight reducing features in the topline portion 218.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." Moreover, unless otherwise noted, as defined herein a plurality of particular features does not necessarily mean every particular feature of an entire set or class of the particular features.

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed is:

1. An iron-type golf club head, comprising:

a body comprising a heel portion, a face portion, a sole portion, extending rearwardly from a lower end of the face portion, a toe portion, a hosel, and a topline portion, wherein a sole bar of the body defines a rearward portion of the sole portion; and a cavity defined between the topline portion, the sole portion, and the face portion;

wherein the cavity has one or more openings located at a back portion of the golf club head, the sole bar defines a lower portion of the back portion, and the sole bar defines a portion of the one or more openings;

wherein the one or more openings are non-circular in shape, and at least one of the one or more openings extends from a location proximate a central region of the cavity to a lower and heelward region of the cavity;

wherein the back portion comprises one or more rear panels and the one or more openings are covered by the one or more rear panels to effectively enclose the cavity;

wherein an enclosed cavity region is at least partially defined by a rear surface of the face portion, one or more front surfaces of the one or more rear panels, and a front surface of the sole bar;

wherein the one or more rear panels cover the one or more openings at least on a toe portion of the cavity and a heel portion of the cavity;

wherein the one or more rear panels are affixed to at least the sole bar of the body;

wherein an areal mass of the back portion of the golf club head between the topline portion, the sole portion, the toe portion, and the heel portion is between 0.0005 $g/mm^2$ and 0.00925 $g/mm^2$;

wherein a Z-up of the golf club head is below about 20 mm;

wherein the cavity comprises a lower region rearward of the rear surface of the face portion, forward of the sole bar, above the sole portion, and no higher than the sole bar;

wherein the cavity comprises an upper region rearward of the rear surface of the face portion, forward of the one or more front surfaces of the one or more rear panels, and above the sole bar; and wherein the iron-type golf club head further comprises a non-metal insert within the cavity between and in contact with only a portion of the back portion and only a portion of the rear surface of the face portion such that the non-metal insert does not contact any portion of the one or more rear panels.

2. The iron-type golf club head according to claim 1, wherein the one or more rear panels are affixed to the body by adhesion.

3. The iron-type golf club head according to claim 2, wherein the one or more rear panels are affixed to a cavity rim of the body by adhesion.

4. The iron-type golf club head according to claim 2, wherein the one or more rear panels are affixed to a cavity edge of the body by adhesion.

5. The iron-type golf club head according to claim 2, wherein a mass of the one or more rear panels divided by a volume of the one or more rear panels yields a value between 1 g/cc and 2 g/cc.

6. The iron-type golf club head according to claim 5, wherein at least a portion of the one or more rear panels comprises a fiber-reinforced polymer.

7. The iron-type golf club head according to claim 1, wherein the face portion has a variable thickness including a maximum thickness and a minimum thickness, and the minimum thickness is no more than 2 mm.

8. The iron-type golf club head according to claim 1, wherein at least one of the one or more openings extends from a location proximate a central region of the cavity to a lower and toeward region of the cavity and extends to an upper and toeward region of the cavity.

9. The iron-type golf club head according to claim 1, wherein an areal mass of the back portion of the golf club head between the topline portion, the sole portion, the toe portion, and the heel portion is between 0.0037 g/mm$^2$ and 0.00925 g/mm$^2$.

10. The iron-type golf club head according to claim 1, wherein the golf club head has a coefficient of restitution (COR) greater than 0.79.

11. The iron-type golf club head according to claim 1, wherein the insert is a foam filler material.

12. The iron-type golf club head according to claim 1, wherein the insert provides at least one of acoustic control and damping.

13. The iron-type golf club head according to claim 1, wherein the insert is located in the upper region of the cavity.

14. The iron-type golf club head according to claim 1, wherein the insert is located in the lower region of the cavity.

15. The iron-type golf club head according to claim 1, wherein the insert extends within the enclosed cavity region from a first location proximate the toe portion of the cavity to a second location proximate the heel portion of the cavity.

16. The iron-type golf club head according to claim 1, wherein the topline portion comprises weight reducing and stiffening features comprising:

a rearwardly and downwardly directed overhang; and a plurality of ribs coupled to an underside of the overhang.

17. The iron-type golf club head according to claim 1, further comprising a channel formed in the sole portion and extending substantially parallel to the face portion.

18. The iron-type golf club head according to claim 1, wherein:

the toe portion of the body defines part of a toe of the iron-type golf club head;

the toe of the iron-type golf club head is at least partially made of a material having a first density;

the body is made of a material having a second density; and the first density is less than the second density.

19. The iron-type golf club head according to claim 1, wherein the one or more rear panels are affixed to at least the sole bar of the body such that in a direction, parallel with a strike face of the face portion, the lower region of the cavity is below the one or more rear panels.

20. The iron-type golf club head according to claim 1, wherein:

the Z-up of the golf club head is below about 18 mm; the golf club head has a coefficient of restitution (COR) greater than 0.79;

the heel portion, the face portion, the sole portion, the toe portion, the hosel, and the topline portion form a one-piece monolithic and seamless construction; and a maximum thickness of a forward portion of the sole portion, located between the sole bar and the strike face, is from 0.8 mm to 2.5 mm.

21. The iron-type golf club head according to claim 1, wherein the back portion comprises a stiffening member that spans the cavity, is spaced apart from the face portion, is rigidly fixed to and extends uprightly between the sole portion and the topline portion, and is spaced apart from the heel portion and the toe portion.

22. The iron-type golf club head according to claim 21, wherein at least one of the one or more rear panels is in contact with a portion of the stiffening member.

23. The iron-type golf club head according to claim 1, wherein a ratio of a thickness of a forward portion of the sole portion, adjacent the face portion, to an average thickness of the face portion is no more than 2.5.

24. The iron-type golf club head according to claim 23, wherein a ratio of a thickness of a forward portion of the sole portion, adjacent the face portion, to an average thickness of the face portion is no more than 1.25.

* * * * *